US007851113B2

(12) United States Patent
Bender et al.

(10) Patent No.: US 7,851,113 B2
(45) **Date of Patent: *Dec. 14, 2010**

(54) ELECTROPHOTOGRAPHIC PHOTORECEPTORS HAVING REDUCED TORQUE AND IMPROVED MECHANICAL ROBUSTNESS

(75) Inventors: Timothy P. Bender, Toronto (CA); Nan-Xing Hu, Oakville (CA); John F. Graham, Oakville (CA); Yvan Gagnon, Mississauga (CA); Cheng-Kuo Hsiao, Mississauga (CA); Sandra J. Gardner, Oakville (CA); Kathy L. De Jong, Mississauga (CA); James M. Markovics, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 753 days.

This patent is subject to a terminal disclaimer.

(21) Appl. No.: 11/610,132

(22) Filed: Dec. 13, 2006

(65) Prior Publication Data

US 2008/0166643 A1 Jul. 10, 2008

Related U.S. Application Data

(60) Provisional application No. 60/863,842, filed on Nov. 1, 2006.

(51) Int. Cl.
*G03G 5/047* (2006.01)
*G03G 5/147* (2006.01)

(52) U.S. Cl. ..... 430/58.2; 430/59.6; 430/66; 524/404; 399/159

(58) Field of Classification Search ..... 430/66, 430/59.6, 58.2; 399/159; 524/404
See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 4,286,033 | A | 8/1981 | Neyhart et al. | |
| 4,291,110 | A | 9/1981 | Lee | |
| 4,298,697 | A | 11/1981 | Baczek et al. | |
| 4,338,387 | A | 7/1982 | Hewitt | |
| 4,338,390 | A | 7/1982 | Lu | |
| 4,464,450 | A | 8/1984 | Teuscher | |
| 4,555,463 | A | 11/1985 | Hor et al. | |
| 4,560,635 | A | 12/1985 | Hoffend et al. | |
| 4,587,189 | A | 5/1986 | Hor et al. | |
| 4,921,773 | A | 5/1990 | Melnyk et al. | |
| 5,096,795 | A * | 3/1992 | Yu | 430/58.8 |
| 5,689,768 | A * | 11/1997 | Ehara et al. | 430/66 |
| 6,016,414 | A * | 1/2000 | Anayama et al. | 430/66 |
| 6,071,661 | A * | 6/2000 | Hsieh et al. | 430/67 |
| 6,261,729 | B1 | 7/2001 | Yuh et al. | |
| 6,365,309 | B1 * | 4/2002 | Tokutake et al. | 430/67 |
| 6,730,448 | B2 | 5/2004 | Yoshino et al. | |
| 6,946,226 | B2 | 9/2005 | Wu et al. | |
| 7,524,596 | B2 * | 4/2009 | Bender et al. | 430/56 |
| 2003/0054271 | A1 * | 3/2003 | Yao et al. | 430/66 |
| 2004/0013442 | A1 * | 1/2004 | Suzuki et al. | 430/66 |
| 2004/0086794 | A1 | 5/2004 | Yamada et al. | |
| 2004/0126685 | A1 * | 7/2004 | Horgan et al. | 430/58.3 |
| 2006/0073399 | A1 | 4/2006 | Bender et al. | |
| 2006/0115755 | A1 | 6/2006 | Bender et al. | |
| 2006/0154161 | A1 | 7/2006 | Qi et al. | |
| 2006/0204873 | A1 | 9/2006 | Tong et al. | |

FOREIGN PATENT DOCUMENTS

| | | |
|---|---|---|
| JP | A 57-128344 | 8/1982 |
| JP | B2 60-22347 | 6/1985 |
| JP | A 63-65449 | 3/1988 |
| JP | A 4-15659 | 1/1992 |
| JP | B2 5-47104 | 7/1993 |
| JP | 2001296767 A * | 10/2001 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*
English language machine translation of JP 2001-296767 (Oct. 2001).*
U.S. Appl. No. 10/998,585, filed Nov. 30, 2004, to Bender et al.
U.S. Appl. No. 10/938,887, filed Sep. 13, 2004, to Bender et al.
U.S. Appl. No. 11/034,062, filed Jan. 13, 2005, to Graham et al,.
U.S. Appl. No. 11/073,548, filed Mar. 8, 2005, to Tong et al.
U.S. Appl. No. 11/234,275, filed Sep. 26, 2005, to Dinh et al.
U.S. Appl. No. 11/295,134, filed Dec. 13, 2005, to Yanus et al.

* cited by examiner

*Primary Examiner*—Christopher RoDee
(74) *Attorney, Agent, or Firm*—Oliff & Berridge, PLC

(57) ABSTRACT

Overcoat layers, which may be useful for reducing torque in electrophotographic photoreceptors, are provided. The overcoat layers include a polymer matrix having a particulate inorganic lubricant and a particulate fluoropolymer uniformly dispersed therein. Also provided are electrophotographic photoreceptors that include a substrate and the overcoat layers, electrophotographic imaging apparatuses that include such photoreceptors, and methods for forming the photoreceptors.

16 Claims, 3 Drawing Sheets

ELECTROPHOTOGRAPHIC PHOTORECEPTORS HAVING REDUCED TORQUE AND IMPROVED MECHANICAL ROBUSTNESS

TECHNICAL FIELD

This disclosure relates to electrophotographic imaging members and, more specifically, to layered photoreceptor structures having one or more layers containing dopants that reduce torque and increase mechanical robustness. In particular, this disclosure relates to photoreceptor overcoat layers comprising particulate inorganic lubricants and particulate fluoropolymers dispersed in a polymer matrix. This disclosure also relates to processes for making and using the imaging members.

RELATED APPLICATIONS

Commonly assigned U.S. patent application Ser. No. 10/998,585 filed Nov. 30, 2004, to Bender et al., describes a silicon-containing layer for electrophotographic photoreceptors comprising: one or more siloxane-containing compound; and one or more siloxane-containing antioxidant; wherein the siloxane-containing antioxidant is at least one member selected from the group consisting of hindered phenol antioxidants, hindered amine antioxidants, thioether antioxidants and phosphite antioxidants.

Commonly assigned U.S. patent application Ser. No. 10/938,887, filed Sep. 13, 2004, to Bender et al., describes a silicon layer for electrophotographic photoreceptors comprising one or more siloxane-containing compound; and an antioxidant; wherein the antioxidant is at least one selected from the group consisting of hindered phenol antioxidants, hindered amine antioxidants, thioether antioxidants and phosphite antioxidants.

Commonly assigned U.S. patent application Ser. No. 11/034,062, filed Jan. 13, 2005, to Graham et al., describes an aromatic silicon-containing compound, having the formula (I): $Ar—[X\text{-}L\text{-}SiR_n(OR')_{3-n}]_m$ (I) wherein: Ar represents an aromatic group; X represents a divalent or trivalent group; L represents a divalent linking group; R represents a hydrogen atom, an alkyl group or an aryl group; R' represents an alkyl group having 1 to 5 carbon atoms; n is an integer of from 0 to 2; and m is an integer of from 1 to 5.

Commonly assigned U.S. patent application Ser. No. 11/073,548, filed Mar. 8, 2005, to Tong et al., describes an imaging member comprising: a substrate, a charge generating layer, a charge transport layer, and an external overcoating layer comprising an electron conductive material.

Commonly assigned U.S. patent application Ser. No. 11/234,275, filed Sep. 26, 2005, to Dinh et al., describes an electrophotographic imaging member comprising: a substrate, a charge generating layer, a charge transport layer, and an overcoating layer, said overcoating layer comprising a cured polyester polyol or cured acrylated polyol film forming resin and a charge transport material.

Commonly assigned U.S. patent application Ser. No. 11/295,134, filed Dec. 13, 2005, to Yanus et al, describes an electrophotographic imaging member comprising: a substrate, a charge generating layer, a charge transport layer, and an overcoating layer, said overcoating layer comprising a terphenyl arylamine dissolved or molecularly dispersed in a polymer binder.

Commonly assigned, U.S. patent application Ser. No. 11/610,223 filed Dec. 13, 2006 to Timothy P. Bender et al., describes a backing layer for electrophotographic photoreceptors, comprising: a polymer matrix; a particulate inorganic lubricant; and a particulate fluoropolymer; wherein the particulate inorganic lubricant and the particulate fluoropolymer are uniformly dispersed throughout the matrix.

Appropriate components and process aspects of each of the foregoing may be selected for the present disclosure in embodiments thereof. The entire disclosures of the above-mentioned applications are totally incorporated herein by reference.

REFERENCES

U.S. Pat. No. 4,265,990 to Stolka et al. describes an imaging member comprising a charge generation layer comprising a layer of photoconductive material and a contiguous charge transport layer of a poly carbonate resin material having a molecular weight of from about 20,000 to about 120,000 having dispersed therein from about 25 to about 75 percent by weight of one or more compounds having the general formula:

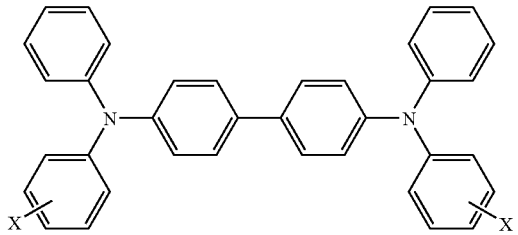

wherein X is selected from the group consisting of an alkyl group, having from 1 to about 4 carbon atoms and chlorine, said photoconductive layer exhibiting the capability of photogeneration of holes and injection of said holes and said charge transport layer being substantially nonabsorbing in the spectral region at which the photoconductive layer generates and injects photogenerated holes but being capable of supporting the injection of photogenerated holes from said photoconductive layer and transporting said holes through said charge transport layer.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

In U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport binders, can be selected for the imaging members of the present disclosure in embodiments thereof.

JP-A-63-65449 (the term "JP-A" as used herein means an "unexamined published Japanese patent application") describes an electrophotographic sensitive body provided with a conductive substrate and a photosensitive layer formed on it and the surface layer located farthest from the substrate containing ≧1 kinds of fluorinated polyarylates and ≧1 kinds of flurororesin powders dispersed into this resin.

JP-B-5-47104 (the term "JP-B" as used herein means an "examined Japanese patent publication") describes a magnetic head for a video signal recording/reproducing the video signal and the magnetic head for an audio signal recording/reproducing the audio signal are provided on a rotary drum in a magnetic recording and reproducing device recording the audio signal and the video signal successively in the same track, then the magnetic head for a video signal and the magnetic head for an audio signal are arranged to be adjacent to each other so as to have respective reverse-azimuth angles.

JP-B-60-22347 describes a substrate for semiconductor element mounting in which the surface of a substrate composed of SiC or $Si_3N_4$ is covered with an inorganic substance which has a good affinity with glass with a thickness of 0.1-20 μm; the substance is chosen among BN, $Al_2O_3$, $Y_2O_3$ and 2MgO—SiO.

JP-A-57-128344 describes an electrophotographic photoreceptor in which a photoconductive layer is formed on a conductive substrate, and on this layer a 3-15 μm thick transparent protective layer is formed; a fine powder of 0.15 μm average particle diameter containing $SnO_2$ and $Sb_2O_5$ in a weight ratio of 98:2-70:30, being mixed, such as the $Sb_2O_5$ powder being melt attached to the surface of the $SnO_2$ powder in each particle, or the two oxides being converted into a solid solution, is uniformly dispersed into a resin, such as polyurethane to give the protective layer; a barrier layer for preventing charge injection or an interlayer for enhancing adhesion may be formed between the photoconductive layer and the protective layer in ≦3 μm thickness using a resin, $SiO_2$, or the like.

JP-A-4-15659 describes an electrophotographic sensitive body having a protective layer made of the silicate structure capable of transferring charge formed by dehydration condensation of a mixed solution of the hydrolyzate of a silane coupling agent and the charge transfer material, preferably, in a transfer material amount of 10-200 weight % of the hydrolyzate.

U.S. Patent Application Publication US 2004/0086794 to Yamada et al. describes an electrophotographic photoreceptor comprising a conductive support and a photosensitive layer disposed on the conductive support, wherein the photosensitive layer comprises a silicon compound-containing layer containing a silicon compound, and the silicon compound-containing layer further contains a resin, and wherein the photosensitive layer has a peak area in the region of −40 to 0 ppm ($S_1$) and a peak area in the region of −100 to −50 ppm ($S_2$) in a $^{29}$Si-NMR spectrum satisfying the following equation (1):

$$S_1/(S_1+S_2) \geqq 0.5 \quad (1).$$

U.S. Pat. No. 6,730,448 B2 to Yoshino et al. describes an image forming method comprising: developing, with a developing agent, an electrostatic latent image formed on a surface of a photoreceptor to form a toner image; transferring the toner image onto an image receiving member to form a transferred image; and fixing the transferred image onto the image receiving member to form an image, wherein the photoreceptor includes a layer that contains a siloxane compound having charge-transferability and a crosslinking structure, with a compound having acid-adsorbing ability being supplied to the surface of the photoreceptor.

U.S. Pat. No. 3,121,006 to Middleton et al. describes a process for recording a pattern of light and shadow comprising in the absence of activating radiation placing sensitizing electrostatic charges of one polarity on the surface of a xerographically sensitive member comprising a conductive backing and a thin photoconductive insulating layer thereon comprising an insulating organic resin binder and dispersed therein finely-divided particles of an inorganic photoconductive insulating metallic-ions containing crystalline compound having electrons in the nonconductive energy level activatable by illumination to a different energy level whereby an electric charge is free to migrate under an applied electric field in the order of at least $10^3$ volts per cm, the composite resistivity of the layer being at least $10^{10}$ ohms-cm in the absence of illumination and having a decay factor of less than 3.0, exposing the thus charged surface to a pattern of light and shadow to be recorded whereby an electrostatic latent, image is formed corresponding to said pattern and depositing electrically attractable finely-divided marking material selectively in conformity with the electrostatic image thus produced.

U.S. Pat. No. 4,560,635 to Hoffend et al. describes an improved positively charged toner composition comprised of resin particles, pigment particles, and a sulfate charge enhancing additive selected from the group consisting of distearyl dimethyl ammonium methyl sulfate, and behenyl trimethyl ammonium methyl sulfate.

U.S. Pat. No. 4,298,697 to Baczek et al. describes a method of forming shaped polymeric material polymerized from at least two monomers, one said monomer consisting essentially of at least one fluorinated vinyl compound and said other monomer consisting essentially of at least one monomer of the structure

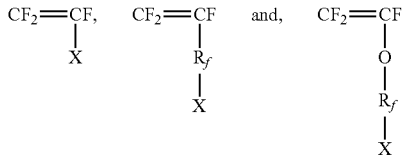

wherein $R_f$ is a bifunctional perfluorinated radical containing from two to eight carbon atoms, which carbon atoms may be interrupted by one or more oxygen atoms and X is selected from the group consisting of sulfonyl fluoride, carbonyl fluoride, sulfonate ester, and carboxylate ester, comprising: dissolving said polymeric material in at least one solvent selected from the group consisting of low molecular weight polymers of perhalogenated alkylethers, low molecular weight polymers of perhalogenated alkyls and perfluorokerosenes, each having boiling points between about 200° C. and 350° C.; shaping said dissolved polymeric material; and thereafter stripping said solvent therefrom to resolidify said polymeric material in the shaped form.

U.S. Pat. No. 4,338,390 to Lu describes a dry electrostatic toner composition comprised of toner particles containing resin particles and pigment particles, and from about 0.1 to about 10 percent based on the weight of the toner particles of an organic sulfate or sulfonate composition of the following formula:

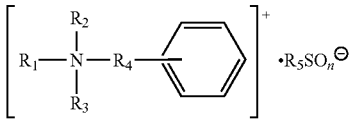

wherein $R_1$ is an alkyl radical containing from about 12 carbon atoms to about 22 carbon atoms, $R_2$ and $R_3$ are independently selected from alkyl groups containing from about 1 carbon atom to about 5 carbon atoms, $R_4$ is an alkyl en e group containing from about 1 carbon atom to about 5 carbon atoms, $R_5$ is a tolyl group or an alkyl group containing from about 1 carbon atom to about 3 carbon atoms and n is the number 3 or 4.

The disclosures of each of the foregoing patents and publications, and the disclosures of any patents and publications cited below, are hereby totally incorporated by reference. The appropriate components and process aspects of the each of the cited patents and publications may also be selected for the present compositions and processes in embodiments thereof.

BACKGROUND

Image-forming apparatus such as copiers, printers and facsimiles, including electrophotographic systems for charging, exposure, development, transfer, etc., using electrophotographic photoreceptors have been widely employed. In such image-forming apparatus, there are ever-increasing demands for improving the speed of the image-forming processes, improving image quality, miniaturizing and prolonging the life of the apparatus, reducing production and running costs, etc. Further, with recent advances in computers and communication technology, digital systems and color-image output systems have been applied also to image-forming apparatus.

Electrophotographic imaging members (i.e. photoreceptors) are well known. Electrophotographic imaging members having either a flexible belt or a rigid drum configuration are commonly used in electrophotographic processes. Electrophotographic imaging members may comprise a photoconductive layer including a single layer or composite layers. These electrophotographic imaging members take many different forms. For example, layered photoresponsive imaging members are known in the art. U.S. Pat. No. 4,265,990 to Stolka et al. describes a layered photoreceptor having separate photo-generating and charge transport layers. The Stolka photo-generating layer is capable of photo-generating holes and injecting the photo-generated holes into the charge transport layer, and the photogenerating material generates electrons and holes when subjected to light.

More advanced photoconductive photoreceptors containing highly specialized component layers are also known. For example, multi-layered photoreceptors may include one or more of a substrate, an undercoating layer, an intermediate layer, an optional hole- or charge-blocking layer, a charge-generating layer (including a photogenerating material in a binder) over an undercoating layer and/or a blocking layer, and a charge-transport layer (including a charge-transport material in a binder). Additional layers, such as one or more overcoat layer or layers, may be included as well.

In view of such a background, improvement in electrophotographic properties and durability, miniaturization, reduction in cost, etc., in electrophotographic photoreceptors have been studied, and electrophotographic photoreceptors using various materials have been proposed.

For example, JP-A-63-65449 (the term "JP-A" as used herein means an "unexamined published Japanese patent application") discloses an electrophotographic photoreceptor in which fine silicone particles are added to a photosensitive layer, and also discloses that such addition of the fine silicone particles imparts lubricity to a surface of the photoreceptor.

Further, in forming a photosensitive layer, a method has been proposed in which a charge-transfer substance is dispersed in a binder polymer or a polymer precursor thereof, and then the binder polymer or the polymer precursor thereof is cured. JP-B-5-47104 (the term "JP-B" as used herein means an "examined Japanese patent publication") and JP-B-60-22347 disclose electrophotographic photoreceptors using silicone materials as the binder polymers or the polymer precursors thereof.

Furthermore, in order to improve mechanical strength of the electrophotographic photoreceptor, a protective layer is formed on the surface of the photosensitive layer in some cases. Often, a cross-linkable resin is used as a material for the protective layer. However, protective layers formed by cross-linkable resin act as insulating layers, which impair the photoelectric characteristics of the photoreceptor. For this reason, a method of dispersing a fine conductive-metal-oxide powder (JP-A-57-128344) or a charge-transfer substance (JP-A-4-15659) in the protective layer and a method of reacting a charge-transfer substance having a reactive functional group with a thermoplastic resin to form the protective layer have been proposed.

However, even such conventional photoreceptors are not necessarily sufficient in electrophotographic characteristics and durability, particularly when they are used in combination with a charger of the contact-charging system (contact charger) or a cleaning apparatus, such as a cleaning blade.

Further, when a photoreceptor is used in combination with a contact charger and a toner obtained by chemical polymerization (polymerization toner), image quality may be deteriorated due to a surface of the photoreceptor being stained with a discharge product produced in contact charging or the polymerization toner remaining after a transfer step. Still further, the use of a cleaning blade to remove discharge product or remaining toner from the surface of the photoreceptor involves friction and abrasion between the surface of the photoreceptor and the cleaning blade, which tends to damage the surface of the photoreceptor, breaks the cleaning blade or turns up the cleaning blade.

The use of silicon-containing compounds in photoreceptor layers, including in photosensitive and protective layers, has been shown to increase the mechanical lifetime of electrophotographic photoreceptors, under charging conditions and scorotron charging conditions. For example, U.S. Patent Application Publication US 2004/0086794 to Yamada et al. discloses a photoreceptor having improved mechanical strength and stain resistance.

Belt-type electrophotographic photoreceptor typically comprises an additional coating layer on the back of the substrate to prevent it from curling. Conventional anti-curling layer is coated from a polycarbonate material. Inside xerographic machine, high friction and abrasion between the backing layer and the other moving parts in contact with remains an issue.

However, there still remains a need for electrophotographic photoreceptors having high mechanical strength and improved electrophotographic characteristics even under conditions of high temperature and high humidity. In addition, there also remains a need for electrophotographic photoreceptors that have having high mechanical strength and long life with respect to non-imaging surfaces.

SUMMARY

The present disclosure addresses these and other needs, by providing protective overcoat layers having reduced torque, for use in electrophotographic imaging members.

Exemplary overcoat layers for electrophotographic imaging members include a polymer matrix; a particulate inorganic lubricant; and a particulate fluoropolymer; wherein the particulate inorganic lubricant and the particulate fluoropolymer are uniformly dispersed throughout the matrix.

Exemplary electrophotographic imaging members include a substrate, a charge-generating layer, a charge-transporting layer, and an overcoat layer; wherein the overcoat layer comprises: a polymer matrix; a particulate inorganic lubricant; and a particulate fluoropolymer; wherein the particulate inorganic lubricant and the particulate fluoropolymer are uniformly dispersed throughout the matrix.

Exemplary electrophotographic imaging apparatuses include an electrophotographic imaging member that comprises a charging unit; a cleaning unit; and a photoreceptor; wherein the photoreceptor comprises: a substrate; an optional hole-blocking layer; a charge-generating layer comprising a photosensitive pigment; a charge-transporting layer comprising a polycarbonate polymer binder and at least one charge-transport material; and an overcoat layer; wherein the overcoat layer comprises: a polymer matrix; a particulate inorganic lubricant; and a particulate fluoropolymer; wherein the particulate inorganic lubricant and the particulate fluoropolymer are uniformly dispersed throughout the matrix.

These and other features and advantages of various embodiments of materials, devices, systems and/or methods are described in or are apparent from, the following detailed description.

EMBODIMENTS

Figure 1A:
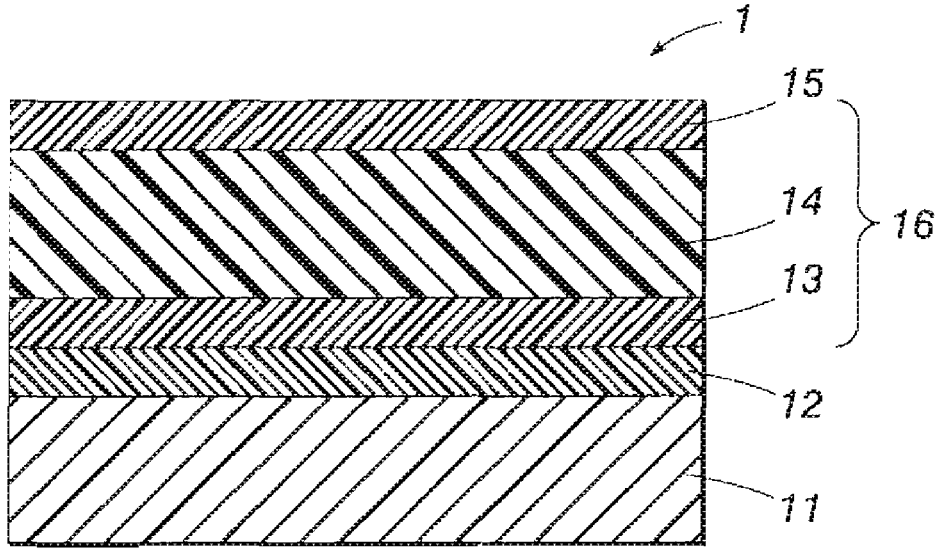
FIG. 1A-1B are schematic cross-sectional views showing embodiments of electrophotographic photoreceptors of exemplary image forming apparatuses.

This disclosure is not limited to particular embodiments described herein, and some components and processes may be varied by one of skill, based on this disclosure. The terminology used herein is for the purpose of describing particular embodiments only, and is not intended to be limiting.

In this specification and the claims that follow, singular forms such as "a," "an," and "the" include plural forms unless the content clearly dictates otherwise. In addition, reference may be made to a number of terms that shall be defined as follows:

The terms "one or more" and "at least one" refer, for example, to instances in which one of the subsequently described circumstances occurs, and to instances in which more than one of the subsequently described circumstances occurs. Similarly, the terms "two or more" and "at least two" refer, for example to instances in which two of the subsequently described circumstances occurs, and to instances in which more than two of the subsequently described circumstances occurs.

The term "organic molecule" refers, for example, to any molecule that is made up predominantly of carbon and hydrogen, such as, for example, alkanes and arylamines. The term "heteroatom" refers, for example, to any atom other than carbon and hydrogen. Typical heteroatoms included in organic molecules include oxygen, nitrogen, sulfur and the like. The term "inorganic molecule" refers, for example, to molecules that are not organic molecules.

The expression "molecularly dispersed" refers, for example, to a charge-transporting small molecule dispersed in a polymer on a molecular scale.

The terms "standard temperature" and "standard pressure" refer, for example, to the standard conditions used as a basis where properties vary with temperature and/or pressure. Standard temperature is 0° C.; standard pressure is 101,325 Pa or 760.0 mmHg. The term "room temperature" refers, for example, to temperatures in a range of from about 20° C. to about 25° C.

The terms "high-temperature environment" and "high-temperature conditions" refer, for example, to an atmosphere in which the temperature is at least about 28 or about 30° C., and may be as high as about 300° C. The terms "high-humidity environment" and "high-humidity conditions" refer, for example, to an atmosphere in which the relative humidity is at least about 75 or about 80%.

"Optional" or "optionally" refer, for example, to instances in which subsequently described circumstance may or may not occur, and include instances in which the circumstance occurs and instances in which the circumstance does not occur.

Image Forming Apparatus and Process Cartridge

The electrophotographic photoreceptor of embodiments may be either a function-separation-type photoreceptor, in which a layer containing a charge-generating substance (charge-generating layer) and a layer containing a charge-transfer substance (charge-transfer layer) are separately provided, or a monolayer-type photoreceptor, in which both the charge-generating layer and the charge-transfer layer are contained in the same layer. The electrophotographic photoreceptor of the invention will be described in greater detail below, taking the function-separation-type photoreceptor as an example.

Figure 1B:
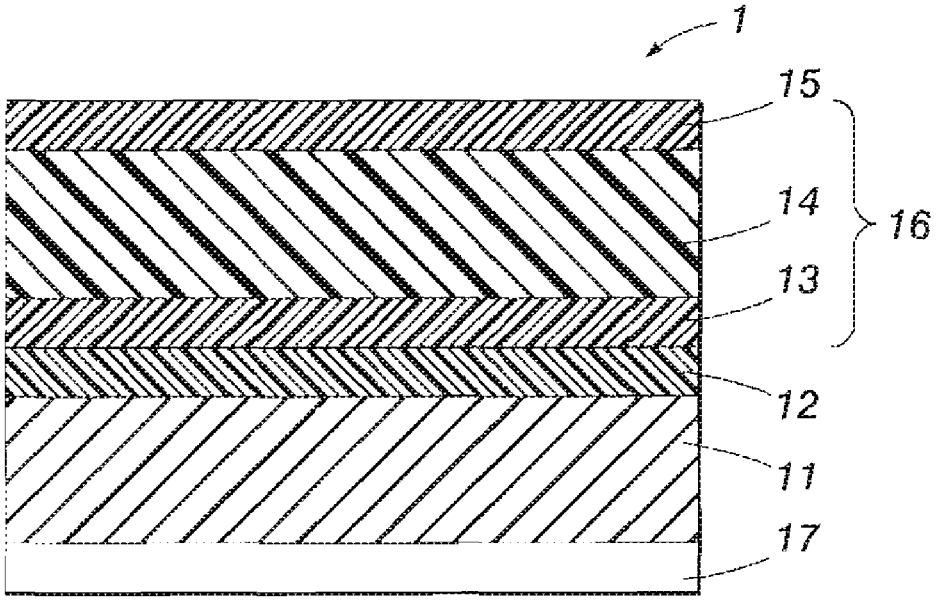

FIGS. 1A and 1B are cross-sectional views schematically showing exemplary embodiments of electrophotographic photoreceptors. The electrophotographic photoreceptor 1 shown in FIGS. 1A and 1B is a function-separation-type photoreceptor in which a charge-generating layer 13 and a charge-transport layer 14 are separately provided. That is, an underlayer 12, the charge-generating layer 13, and the charge-transport layer 14 are laminated onto a conductive support 11 to form a photosensitive layer 16.

The conductive support 11 may include, for example, a metal plate, a metal dram or a metal belt using a metal such as aluminum, copper, zinc, stainless steel, titanium, chromium, nickel, molybdenum, vanadium, indium, gold or a platinum, or an alloy thereof; and paper or a plastic film or belt coated, deposited or laminated with a conductive polymer, a conductive compound such as indium oxide, a metal such as aluminum, palladium or gold, or an alloy thereof. Further, surface treatment (such as anodic oxidation coating, hot water oxidation, chemical treatment, or coloring) or diffused reflection treatment (such as graining) can also be applied to a surface of the support 11.

Binding resins used in the underlayer 12 of embodiments may include but are not limited to, one or more polyamide resins, vinyl chloride resins, vinyl acetate resins, phenol resins, polyurethane resins, melamine resins, benzoguanamine resins, a polyimide resins, polyethylene resins, polypropylene resins, polycarbonate resins, acrylic resins, methacrylic resins, vinylidene chloride resins, polyvinyl acetal resins, vinyl chloride-vinyl acetate copolymers, polyvinyl alcohol resins, a water-soluble polyester resins, nitrocelluloses, caseins, gelatins, polyglutamic acids, starches, starch acetates, amino starches, polyacrylic acids, polyacrylamides, zirconium chelate compounds, titanyl chelate compounds, titanyl alkoxide compounds, organic titanyl compounds, silane coupling agents and mixtures thereof. Further, fine particles of titanium oxide, aluminum oxide, silicon oxide, zirconium oxide, barium titanate, a silicone resin or the like may be added to the above-mentioned binding resin in embodiments.

A suitable hole blocking layer may be comprised of polymers such as polyvinyl butyral, epoxy resins, polyesters, polysiloxanes, polyamides, polyurethanes, and the like, nitrogen-containing siloxanes or nitrogen-containing titanium compounds, such as trimethoxysilyl propyl ethylene diamine, N-beta (aminoethyl) gamma-aminopropyl trimethoxy silane, isopropyl 4-aminobenzene sulfonyl titanate, di(dodecylbenezene sulfonyl)titanate, isopropyl di(4-aminobenzoyl)isostearoyl titanate, isopropyl tri(N-ethyl amino)titanate, isopropyl trianthranil titanate, isopropyl tri(N,N-dimethyl-ethyl amino)titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, for example as disclosed in U.S. Pat. No. 4,338,387, 4,286,033 and 4,291,110, each incorporated herein by reference in their entireties.

A suitable hole blocking layer may also be comprised of a polymer composite composition comprising n-type metal oxide particles, for example as disclosed in U.S. Pat. Nos. 6,261,729 and 6,946,226, each incorporated herein by reference in their entireties. The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by bail milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and Durite™ 97 (available from Borden Chemical); formaldehyde polymers with ammonia, cresol and phenol, such as VARCUM™29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), Durite™ SD-423A, SD-422A (available from Borden Chemical); or formaldehyde polymers with phenol and p-tert-butylphenol, such as Durite™ ESD 556C (available from Border Chemical).

As a coating method in forming the underlayer of embodiments, an ordinary method such, as blade coating, Mayer bar coating, spray coating, dip coating, bead coating, air knife coating or curtain coating may be employed. The thickness of the underlayer may be from 0.01 to 40 μm.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

Non-limiting examples of charge-generating substances that may be contained in the charge-generating layer 13 of embodiments include, but are not limited to, various organic pigments and organic dyes; such as azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes and cyanine dyes; and inorganic materials such as amorphous silicon, amorphous selenium, tellurium, selenium-tellurium alloys, cadmium sulfide, antimony sulfide, zinc oxide and zinc sulfide. In embodiments, cyclocondensed aromatic pigments, perylene pigments and azo pigments may be used to impart sensitivity, electric stability and photochemical stability against irradiated light. These charge-generating substances may be used either alone or as a combination of two or more.

In embodiments, the charge-generating layer 13 may be formed by vacuum deposition of the charge-generating substance or application of a coating solution in which the charge-generating substance is dispersed in an organic solvent containing a binding resin. The binding resins used in the charge-generating layer of embodiments include polyvinyl acetal resins such as polyvinyl butyral resins, polyvinyl formal resins or partially acetalized polyvinyl acetal resins in which butyral is partially modified with formal or acetoacetal, polyamide resins, polyester resins, modified ether type polyester resins, polycarbonate resins, acrylic resins, polyvinyl chloride resins, polyvinylidene chlorides, polystyrene resins, polyvinyl acetate resins, vinyl chloride-vinyl acetate copolymers, silicone resins, phenol resins, phenoxy resins, melamine resins, benzoguanamine resins, urea resins, polyurethane resins, poly-N-vinylcarbazole resins, polyvinylanthracene resins, polyvinylpyrene resins and mixtures thereof. In embodiments in which one or more of polyvinyl acetal resins, vinyl chloride-vinyl acetate copolymers, phenoxy resins or modified ether type polyester resins are used, the dispersibility of the charge-generating substance may be improved to cause no occurrence of coagulation of the charge-generating substance, and a coating solution that is stable for a long period of time may be obtained. The use of such a coating solution in embodiments makes it possible to form a uniform coating easily and surely. As a result, the electric characteristics may be improved, and image defects may be prevented. Further, the compounding ratio of the charge-generating substance to the binding resin may be, in embodiments, within the range of 5:1 to 1:2 by volume ratio.

Specifically, the photogenerating layer in embodiments is comprised of for example, a number of components that permit the photogeneration of charge, such as metal phthalocyanines, metal free phthalocyanines, titanyl phthalocyanines, such as Type V titanyl phthalocyanine, hydroxy gallium phthalocyanies, halo gallium phthalocyanies, perylenes, selenium, and the like. A specific example of a photogenerating pigment that can be selected for the photgenerating layer is Type V hydroxygallium phthalocyanine or chlorogallium phthalocyanine, dispersed in a resin binder like poly (vinyl chloride-co-vinyl acetate) copolymer, such as VMCH (available from Dow Chemical) and a polycarbonate, for example, poly(4,4'-cyclohexylidinediphenylene)carbonate (also referred to as bisphenol-Z-polycarbonate).

Further, the solvents used in preparing the coating solution in embodiments may Include organic solvents such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride, chloroform and mixtures thereof.

Methods for applying the coating solution in embodiments include the coating methods described above with reference to the underlayer 12. The thickness of the charge-generating layer 13 thus formed may be from 0.01 to 5 μn, and from 0.1 to 2 μm. When the thickness of the charge-generating layer 13 is less than 0.01 μm, it becomes difficult to uniformly form the charge-generating layer. On the other hand, when the thickness exceeds 5 μm, the electrophotographic characteristics tend to significantly deteriorate.

Further, a stabilizer such as an antioxidant or an inactivating agent can also be added to the charge-generating layer 13 in embodiments. Non-limiting examples of antioxidants that may be used include but are not limited to antioxidants such as phenolic, sulfur, phosphorus and amine compounds. Inactivating agents that may be used in embodiments may include bis(dithiobenzyl)nickel and nickel di-n-butylthiocarbamate.

In embodiments, the charge-transport layer 14 can be formed by applying a coating solution containing the charge-transport substance and a binding resin, and further fine particles, an additive, etc., as described above.

Low molecular weight charge-transport substances that may be used in embodiments may include, for example, pyrene, carbazole, hydrazone, oxazole, oxadiazole, pyrazoline, arylamine, arylmethane, benzidine, thiazole, stilbene and butadiene compounds, hi embodiments, high molecular weight charge-transport substances may be used and include, for example, poly-N-vinylcarbazoles, poly-N-vinylcarbazole halides, polyvinyl pyrenes, polyvinylanthracenes, polyvinylacridines, pyrene-formaldehyde resins, ethylcarbazole-formaldehyde resins, triphenylmethane polymers and polysilanes. Triphenylamine compounds, triphenylmethane compounds and benzidine compounds may be used in embodiments to promote mobility, stability and transparency to light.

Specific examples of components for the charge transport layer include hole transporting components and molecules of the following formula

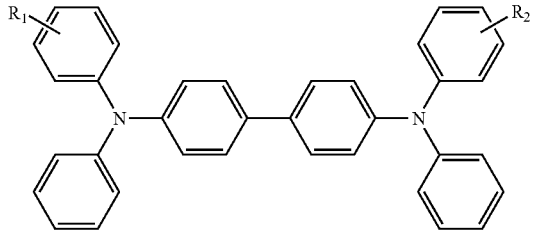

wherein $R_1$ and $R_2$ are each an alkyl, an alkoxy, an aryl, a halogen, and the like. The alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. The aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; and the like. Other known charge transport layer molecules can be selected, reference for example, U.S. Pat. Nos. 4,921,773 and 4,464,450, the disclosures of which are totally incorporated herein by reference.

As binding resins in embodiments, high molecular weight polymers that can form an electrical insulating film may be used. For example, when polyvinyl acetal resins, polyamide resins, cellulose resins, phenol resins, etc., which are soluble in alcoholic solvents, are used, binding resins used together with these resins include polycarbonates, polyesters, methacrylic resins, acrylic resins, polyvinyl chlorides, polyvinylidene chlorides, polystyrenes, polyvinyl acetates, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazoles, polyvinyl butyrals, polyvinyl formals, polysulfones, casein, gelatin, polyvinyl alcohols, phenol resins, polyamides, carboxymethyl celluloses, vinylidene chloride-based polymer latexes and polyurethanes. Of the above-mentioned high molecular weight polymers, polycarbonates, polyesters, methacrylic resins and acrylic resins have excellent compatibility with the charge-transport substance, solubility and strength.

Suitable examples of the binder materials selected for the charge transport layer include polymer components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 can be selected. The charge transport layer may generally be fabricated by dissolving the charge transport molecule and the polymer binder in a suitable solvent to form a coating solution, followed by coating and drying of the coating solution. Examples of solvent for the application include hydrocarbons such as toluene and xylene, halogenated hydrocarbons such as dichloromethane and chlorobenzene, ethers such as tetrahydrofuran, and the like. The coating of the charge transport layer of the present disclosure can be accomplished with spray, dip or wire-bar methods. The solvent may be removed after the coating by drying at a temperature ranging from for example, about 40° C. to about 150° C.

The charge-transport layer 14 of embodiments may further contain an additive such as a plasticizer, a surface modifier, an antioxidant or an agent for preventing deterioration by light.

The thickness of the charge-transport layer 14 may be, in embodiments, from 5 to 50 μm, or from 10 to 40 μm. When the thickness of the charge-transport layer 14 is less than 5 μm, charging becomes difficult. However, thicknesses exceeding 50 μm result significant deterioration of the electrophotographic characteristics.

Protective Overcoat Layers

To improve photoreceptor wear resistance, a protective overcoat layer having reduced torque or friction can be provided over the charge-transport layer. For example, a photoreceptor may include an overcoat layer 15 provided over the imaging layers, as shown in FIG. 1A. Embodiments include overcoat layers that comprise a polymer matrix in which particulate inorganic lubricants and particulate fluoropolymers are uniformly dispersed.

As particulate inorganic lubricants, any known particulate inorganic lubricant may be employed. Suitable particulate inorganic lubricants include boron nitride, graphite, fluorinated graphite, oxidized graphite (also called graphite oxide), molybdenum sulfide, and mixtures thereof. However, in embodiments, the particulate inorganic lubricant may be boron nitride. Because boron nitride has no active surface chemistry, it may be particularly useful for reducing friction in electrophotographic imaging environments. Specifically, its inert surface chemistry reduces the likelihood of chemical reaction on exposure to corona effluents and other chemical contaminants, and it is unlikely to cause electrical problems such as charge trapping.

As particulate fluoropolymers, any known particulate fluoropolymers having lubricant properties may be employed. Suitable particulate fluoropolymers include poly(tetrafluoroethylene) (PTFE), poly(vinylidene fluoride), poly(vinylidene fluoride co-hexafluoropropylene), and mixtures thereof.

In embodiments, the particulate inorganic lubricant may be present in the overcoat layer 15 as a plurality of particles ranging in size of from about 0.05 to about 5 μm, such as about 0.05 to about 0.5 μm or to about 1 μm. Similarly, particulate fluoropolymer of embodiments may be present in the overcoat layer 15 as a plurality of particles ranging in size of from about 0.05 to about 5 μm, such as about 0.05 to about 0.5 μm or to about 1 μm. For example, the particulate inorganic lubricant may be a plurality of boron nitride particles ranging in size of from about 0.05 to about 5 μm, and/or the particulate fluoropolymer may be a plurality of poly(tetrafluoroethylene) particles ranging in size of from about 0.05 to about 5 μm.

The particulate inorganic lubricant and particulate fluoropolymer in the overcoat layer 15 of embodiments may be present in any suitable amounts. However, in particular embodiments, the particulate inorganic lubricant may be present in amounts from about 0.5 to about 10% by weight, relative to a total weight of the overcoat layer 15, and/or the particulate fluoropolymer may be present in amounts from about 1 to about 20% by weight, relative to a total weight of the overcoat layer 15.

The particulate inorganic lubricant and particulate fluoropolymer may be used individually or as composites or mixtures of particulate inorganic lubricants and particulate fluoropolymers. Such composites and mixtures are commercially available and include, for example, a commercially available line of particulate boron nitride and polytetrafluoroethylene (PTFE) from Acheson Colloidal Company, in which boron nitride, PTFE and mixtures thereof are available as dispersions in either alcohol or hydrocarbon. Particles size ranges for these particles are around 1-5 μm. Other commercially available colloidal dispersions include Colloidal PTFE* Emralon® 309 available as a dispersion in Anhydrous Isopropyl Alcohol 20% by weight, Colloidal Boron Nitride SLA 1720 available as a dispersion in Anhydrous Isopropyl Alcohol 20% by weight, Colloidal PTFE* SLA 1612 available as a dispersion in 150 Solvent Refined Paraffinic Petroleum Oil 20% by weight, Colloidal PTFE SLA 1614 available as a dispersion in 150 Solvent Refined Paraffinic Petroleum Oil 20%, by weight, Colloidal Boron Nitride SLA 1710 available as a dispersion in 150 Solvent Refined Paraffinic Petroleum Oil 10% wt, Cerflon® (PTFE/Bn) SLA 2020 available as a dispersion in Anhydrous Isopropyl Alcohol 18% by weight and Cerflon® (PTFE/Bn) SLA 2010 available as a dispersion in 150 Solvent Refined Paraffinic Petroleum Oil 18% by weight.

In embodiments, the overcoat layer 15 may optionally include a charge-transport component, which may be any suitable charge-transport compound. Suitable examples include those discussed above with respect to the charge-transport layer 14. The charge-transport component may be present in any suitable amount, for example, in amounts from about 25 to about 60% by weight, relative to a total weight of the overcoat layer 15.

The polymer matrix used in forming the overcoat layer 15 can be any suitable film-forming resin, including any of those described above or used in other layers of the imaging member. In embodiments, the film-forming resin can be electrically insulating, semi-conductive, or conductive, and can be hole-transporting or non-hole-transporting. Thus, for example, suitable film-forming resins can be selected from, but are not limited to, thermoplastic and thermosetting resins such as polycarbonates, polyesters, polyamides, polyurethanes, polystyrenes, polyarylethers, polysulfones, polysulfones, polyethersulfones, polyphenylene sulfides, polyvinyl acetate, polyacrylates, polyvinyl acetals, polyamides, polyimides, amino resins, phenylene oxide resins, phenoxy resins, epoxy resins, phenolic resins, polystyrene and acrylonitrile copolymers, vinyl acetate copolymers, acrylate coploymers, alkyd resins, styrenebutadiene copolymers, styrene-alkyd resins, polyvinylcarbazole, and the like. In embodiments, the film-forming resin can be a polycarbonate, an aromatic polyester, a polyurethane, a polyimide, and mixtures thereof. In additional embodiments, the film-forming resin can be cross-linked polymer such as a melamine-formaldehyde resin, a phenol-formaldehyde resin, a melamine-phenol-formaldehyde resin, a polysiloxane, and mixtures thereof. These polymers may be block, random or alternating coploymers.

In additional embodiments, the film-forming resin can be a cross-linked polymer such as a melamine-formaldehyde resin, a phenol-formaldehyde resin, a melamine-phenol-formaldehyde resin, a polysiloxane, and mixtures thereof. In particular embodiments the film-forming resin may be a cross-linked polysiloxane, wherein the cross-linked polysiloxane is produced by hydrolysis and condensation of a coating formulation that comprises an aromatic silicon-containing compound of Formula (I) and a silicone-containing hole-transport compound of Formula (II):

$$A\text{-}[L\text{-}SiR_nX_{3-n}]_m \quad (I)$$

$$B\text{-}[L\text{-}SiR_nX_{3-n}]_m \quad (II)$$

In Formulas (I) and (II), A is a multiple-valent organic group; B is a hole-transport moiety; L is a divalent linkage; R is a hydrocarbon group selected from the group consisting of alkyl groups, arylalkyl groups, aryl groups, and alkylaryl groups; X is a hydrolytic group; m is an integer from 1 to 6; n is an integer from 0 to 2; and the m, n, L, R, and X of Formulas (I) and (II) are independently selected.

The divalent linkage L in Formulas (I) and (II) may be, in embodiments, independently selected from groups such as $$-(CH_2)_y-,\quad -O-(CH_2)_y-,$$

$$-S-(CH_2)_y-,\quad -\overset{O}{\overset{\|}{C}}-O-(CH_2)_y-,$$

$$-O-\overset{O}{\overset{\|}{C}}-O-(CH_2)_y-,$$

$$-(CH_2)_z-\overset{O}{\overset{\|}{C}}-O-(CH_2)_y-,$$

$$-O-\overset{O}{\overset{\|}{C}}-NH-(CH_2)_y-,$$

$$-CH{=}CH-(CH_2)_y-,\quad \text{and}$$

$$-CH{=}CH-\overset{O}{\overset{\|}{C}}-O-(CH_2)_y-;$$

in which y is an integer from 1 to about 6 and z is an integer from 1 to about 6.

Similarly, multiple-valent organic group A may be chosen, in embodiments, from

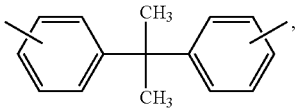

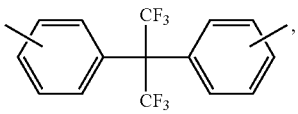

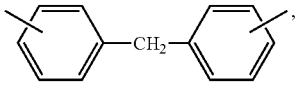

-continued

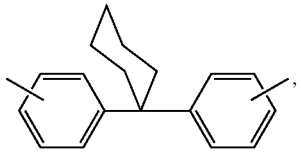

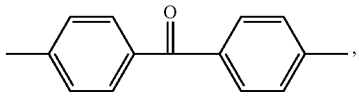

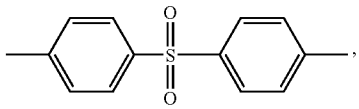

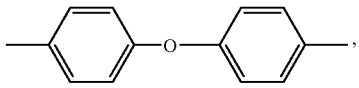

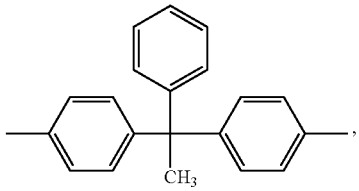

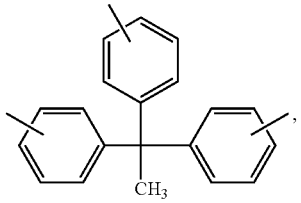

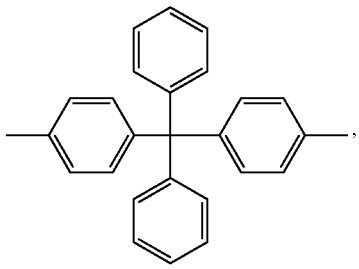

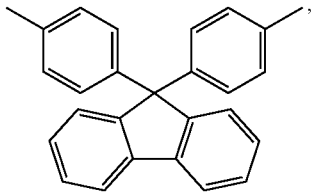

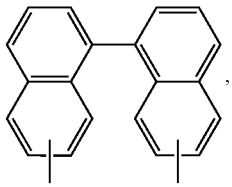

-continued

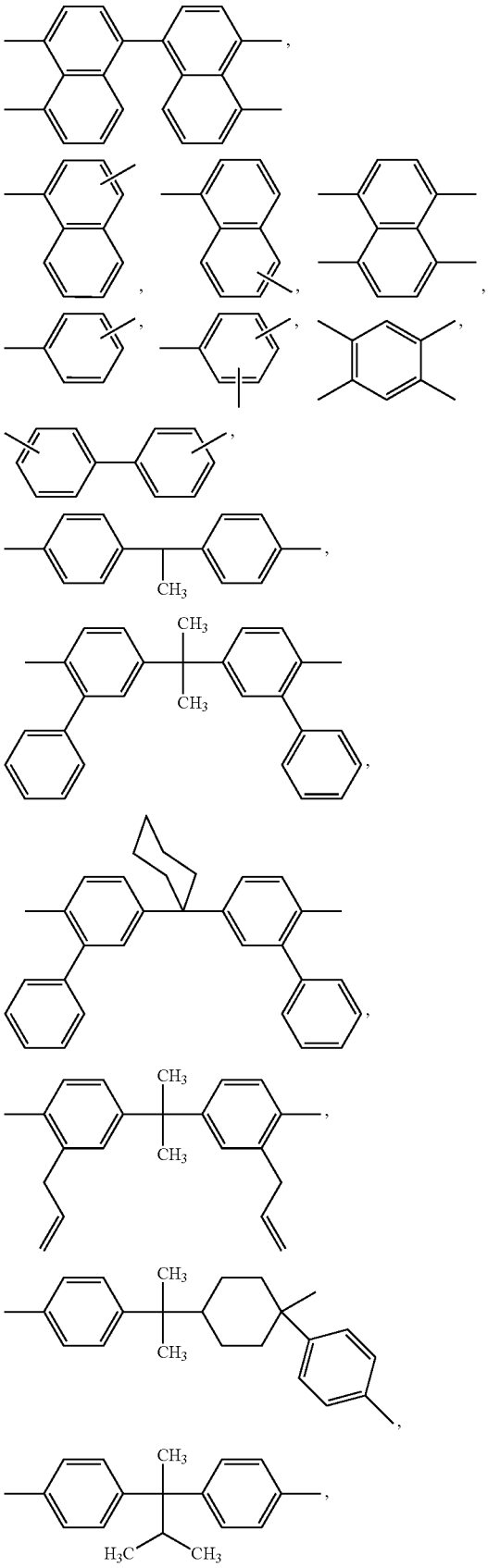

-continued

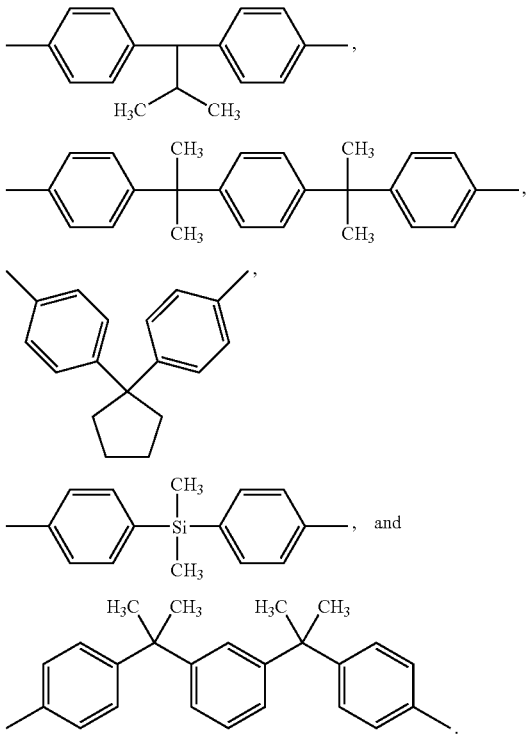

Likewise, B may be a tertiary aromatic amine of Formula (III).

(III)

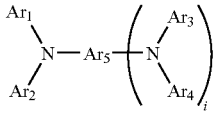

In Formula (III), $Ar_1$, $Ar_2$, $Ar_3$ and $Ar_4$ are each independently selected from the group consisting of substituted and unsubstituted aryl groups; $Ar_5$ is chosen from the group consisting of substituted and unsubstituted aryl and arylene groups; i is 0 or 1; and at least one of $Ar_1$, $Ar_2$, $Ar_3$, $Ar_4$ and $Ar_5$ includes a bonding site that may connect to the silyl component of Formula (II).

In some embodiments, the silicon-containing compound of Formula (I) may be selected from the group consisting of compounds of Formulas (I-A), (I-B) and (I-C), in which R' is an alkyl group having from 1 to about 4 carbon atoms.

(I-A)

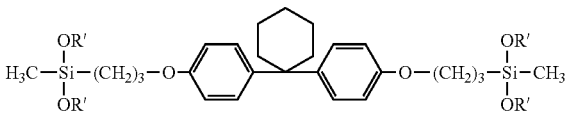

-continued
(I-B)
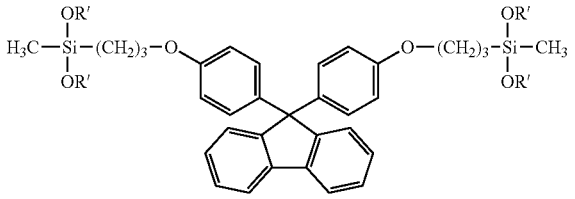
-continued
(I-C)
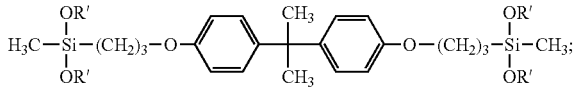
In embodiments, wherein the silicon-containing hole-transport compound of Formula (II) may be selected from the group consisting of compounds of Formulas (II-A) through (II-N), in which R' is an alkyl group having from 1 to about 4 carbon atoms.
(II-B)
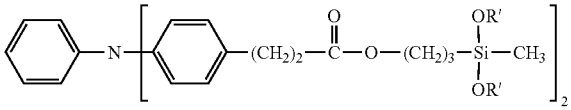
(II-A)
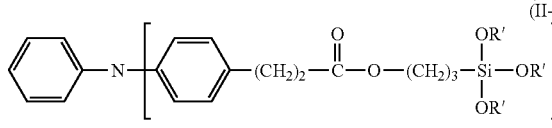
(II-D)
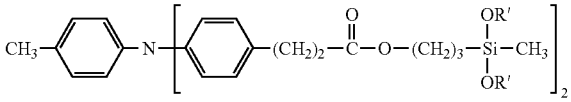
(II-C)
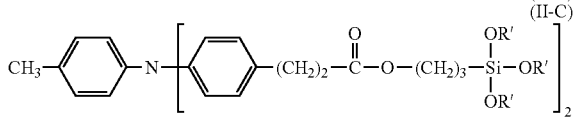
(II-F)
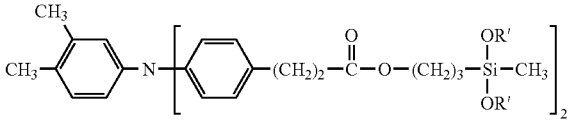
(II-E)
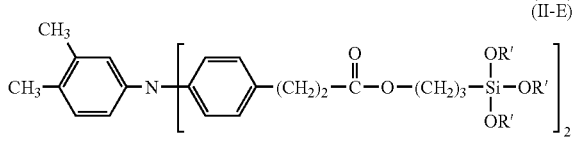
(II-G)
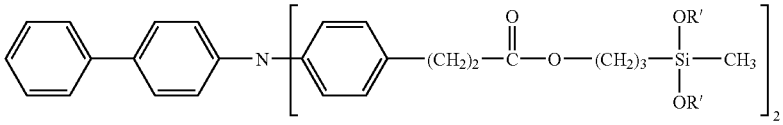
(II-H)
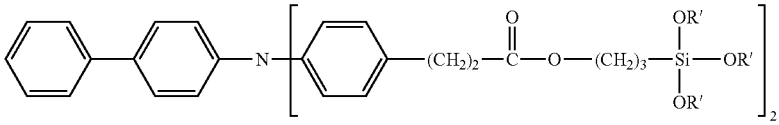
(II-I)
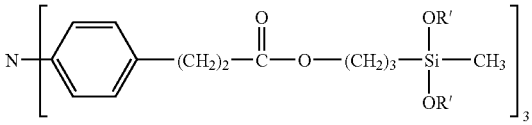
(II-J)
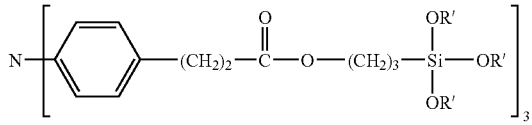
(II-K)
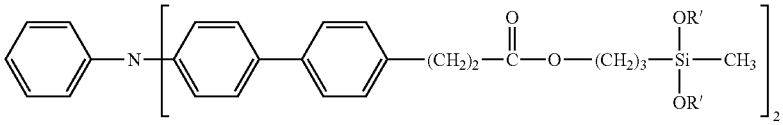
(II-L)
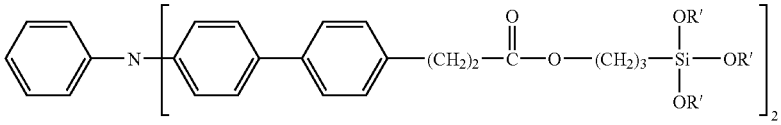

-continued

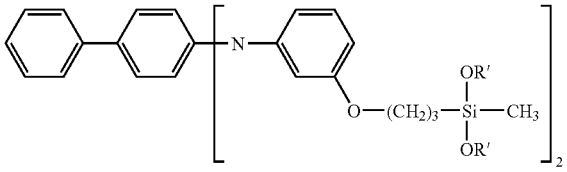

(II-N)

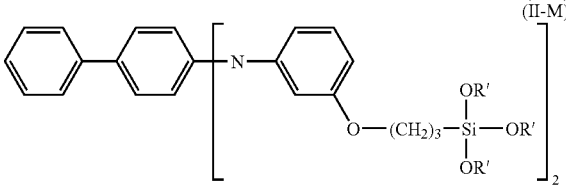

(II-M)

Any suitable alcohol solvent may be employed for applying the overcoat layer 15. Typical alcohol solvents include, for example, butanol, propanol, methanol, and the like and mixtures thereof. Other suitable solvents that can be used in forming the overcoat layer solution include, for example, tetrahydrofuran, monochloro benzene, and mixtures thereof. These solvents can be used in addition to, or in place of, the above alcohol solvents, or they can be omitted entirely.

In embodiments, the components utilized in the overcoat layer solution of this disclosure may be soluble in the solvents or solvents employed for the overcoat layer. When at least one component in the overcoat layer mixture is not soluble in the solvent utilized, phase separation can occur, which may adversely affect the transparency of the overcoat layer 15 and electrical performance of the final imaging member.

The thickness of the overcoat layer 15 depends upon the abrasiveness of its environment, for example the charging (e.g., bias charging roll), cleaning (e.g., blade or web), development (e.g., brush), transfer (e.g., bias transfer roll), etc., in the system employed, and can range from about 1 or about 2 μm up to about 10 or about 15 μm or more. For example, the overcoat layer 15 may have a thickness of between about 1 and about 5 μm, in certain embodiments. Typical application techniques include spraying, dip coating, roll coating, wire-wound-rod coating, and the like. Drying of the deposited coating may be effected by any suitable conventional technique such as oven drying, infrared-radiation drying, air drying and the like.

The overcoat layers of embodiments may be provided as on any surface that is exposed to mechanical wear. For example, an overcoat layer as described herein may be used as the outermost layer of a drum-type or belt-type photoreceptor, which contacts, for example, cleaning blades. Where the overcoat layers of embodiments are provided as an outermost layer of drum-type or belt-type photoreceptors, friction is reduced, relative to conventional photoreceptor layers, between this layer and mechanical parts, such as, for example, cleaning blades. This results in reduced mechanical wear and increased life of the photoreceptors and of the mechanical parts.

Backing Layers

To improve wear resistance between the photoreceptor and mechanical parts that may contact and abrade the photoreceptor substrate, a backing layer can be provided on a non-imaging surface of the substrate. For example, a belt-type photoreceptor may include a backing layer 17 on the substrate surface opposite the imaging layers, as shown in FIG. 1B. Embodiments include backing layers that comprise a polymer matrix in which particulate inorganic lubricants and particulate fluoropolymers are uniformly dispersed.

As particulate inorganic lubricants, any known, particulate inorganic lubricant may be employed. Suitable particulate inorganic lubricants include boron nitride, graphite, fluorinated graphite, oxidized graphite (also called graphite oxide), molybdenum sulfide, and mixtures thereof, as discussed above with respect to overcoat layers.

As particulate fluoropolymers, any known particulate fluoropolymers having lubricant properties may be employed. Suitable particulate fluoropolymers include poly(tetrafluoroethylene) (PTFE), poly(vinylidene fluoride), poly(vinylidene fluoride co-hexafluoropropylene), and mixtures thereof, as discussed above with respect to overcoat layers.

In embodiments, the particulate inorganic lubricant may be present in the backing layer 17 as a plurality of particles ranging in size of from about 0.05 to about 5 μm, such as about 0.05 to about 0.5 μm or to about 1 μm. Similarly, particulate fluoropolymer of embodiments may be present in the backing layer 17 as a plurality of particles ranging in size of from about 0.05 to about 5 μm, such as about 0.05 to about 0.5 μm or to about 1 μm. For example, the particulate inorganic lubricant may be a plurality of boron nitride particles ranging in size of from about 0.05 to about 5 μm, and/or the particulate fluoropolymer may be a plurality of poly(tetrafluoroethylene) particles ranging in size of from about 0.05 to about 5 μm.

The particulate inorganic lubricant and particulate fluoropolymer in the backing layer 17 of embodiments may be present in any suitable amounts. However, in particular embodiments, the particulate inorganic lubricant may be present in amounts from about 0.5 to about 10% by weight, relative to a total weight of the backing layer 17, and/or the particulate fluoropolymer may be present in amounts from about 1 to about 20% by weight, relative to a total weight of the backing layer 17.

The particulate inorganic lubricant and particulate fluoropolymer in the backing layer 17 may be used individually or as composites or mixtures of particulate inorganic lubricants and particulate fluoropolymers. Suitable composites and mixtures include those discussed above with respect to overcoat layer 15.

The polymer matrix used in forming the backing layer 17 can be any suitable film-forming resin, including any of those described above or used in other layers of the imaging member. In embodiments, the film-forming resin can be electrically insulating, semi-conductive, or conductive. Thus, for example, suitable film-forming resins can be selected from, but are not limited to, thermoplastic and thermosetting resins such as polycarbonates, polyesters, polyamides, polyurethanes, polystyrenes, polyarylethers, polyarylsulfones, polysulfones, polyethersulfones, polyphenylene sulfides, polyvinyl acetate, polyacrylates, polyvinyl acetals, polyamides, polyimides, amino resins, phenylene oxide resins, phenoxy resins, epoxy resins, phenolic resins, polystyrene and acrylonitrile copolymers, vinyl acetate copolymers, acrylate copolymers, alkyd resins, styrenebutadiene copolymers, styrene-alkyd resins, polyvinylcarbazole, and the like. In embodiments, the film-forming resin can be a polycarbonate, an aromatic polyester, a polyurethane, a polyimide, and mixtures thereof. In additional embodiments, the film-forming resin can be a cross-linked polymer such as a melamine-formaldehyde resin, a phenol-formaldehyde resin, a melamine-phenol-formaldehyde resin, a polysiloxane, and mixtures thereof. These polymers may be block, random or alternating copolymers. In particular embodiments, the polymer matrix of the backing layer 17 may include a polycarbonate polymer having a number-average molecular weight of not less than 35,000.

Any suitable alcohol solvent may be employed for applying the backing layer 17 depending on the polymer matrix materials. Typical alcohol solvents for melamine resin and phenol resin include, for example, butanol, propanol, methanol, and the like and mixtures thereof. Other suitable solvents that can be used in forming the backing layer solution include, for example, methylene chloride, tetrahydrofuran, monochloro benzene, and mixtures thereof.

In embodiments, the components utilized in the backing layer solution of this disclosure may be soluble in the solvents or solvents employed for the backing layer 17. When at least one component in the backing layer mixture is not soluble in the solvent utilized, phase separation can occur, which may adversely affect the transparency of the backing layer 17 and electrical performance of the final imaging member.

The thickness of the backing layer 17 depends upon the abrasiveness of its environment, for example the mechanical parts such as rollers, bearings and the like, in the system employed, and can range from about 1 or about 2 μm up to about 10 or about 15 μm or more. For example, the backing layer 17 may have a thickness of between about 1 and about 5 μm, in certain embodiments. Typical application techniques include spraying, dip coating, roll coating, wire-wound-rod coating, and the like. Drying of the deposited coating may be effected by any suitable conventional technique such as oven drying, infrared-radiation drying, air drying and the like.

Where the backing layers of embodiments are provided as protective backing layers or anti-curl backing layers of belt-type photoreceptors, friction is reduced, relative to conventional photoreceptor layers, between the backing layer and other mechanical parts such as, for example, rollers used to move the photoreceptor belt. This results in reduced mechanical wear and increased life of the photoreceptors and of the other mechanical parts in contact with the photoreceptors.

Image Forming Apparatus and Process Cartridge

Figure 2:
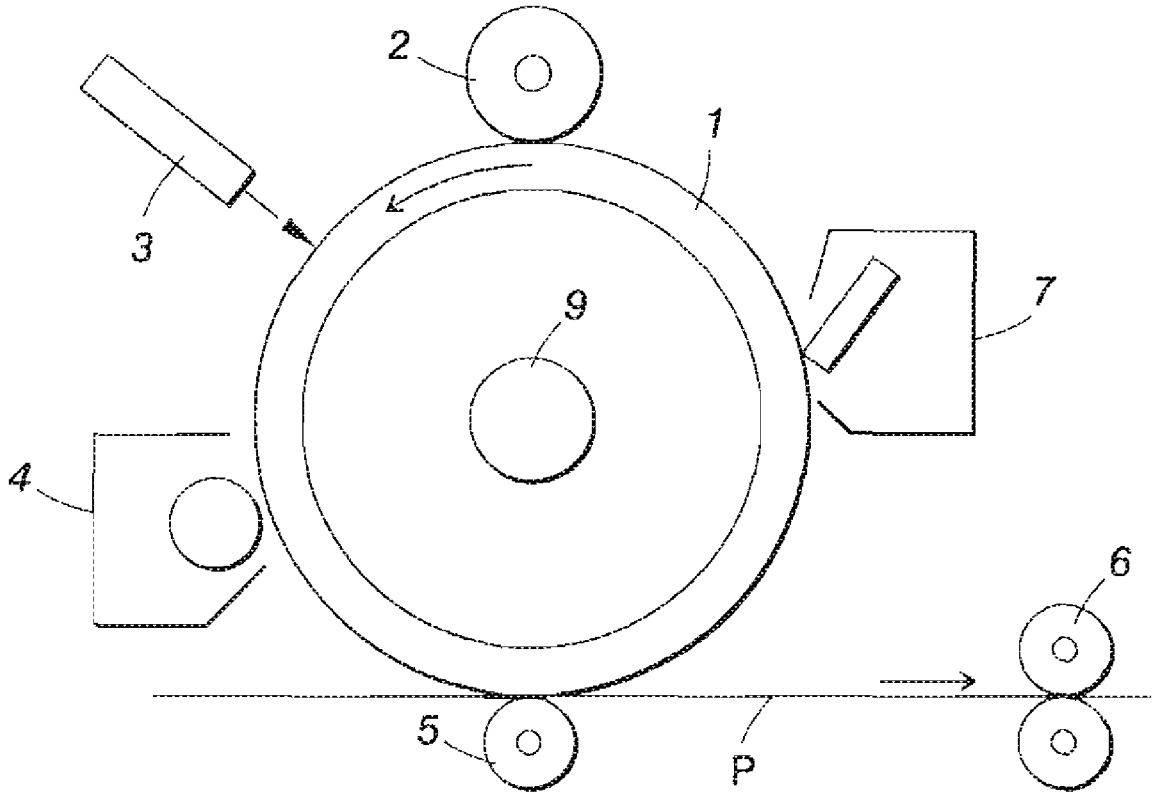
FIG. 2 is a schematic view showing an embodiment of an image forming apparatus.

FIG. 2 is a schematic view showing an embodiment of an image forming apparatus. In the apparatus shown in FIG. 2, the electrophotographic photoreceptor 1 constituted as shown in FIG. 1 is supported by a support 9, and rotatable at a specified rotational speed in the direction indicated by the arrow, centered on the support 9. A contact charging device 2, an exposure device 3, a developing device 4, a transfer device 5 and a cleaning unit 7 are arranged in this order along the rotational direction of the electrophotographic photoreceptor 1. Further, this exemplary apparatus is equipped with an image fixing device 6, and a medium P to which a toner image is to be transferred is conveyed to the image fixing device 6 through the transfer device 5.

The contact charging device 2 has a roller-shaped contact charging member. The contact charging member is arranged so that it comes into contact with a surface of the photoreceptor 1, and a voltage is applied, thereby being able to give a specified potential to the surface of the photoreceptor 1. In embodiments, a contact charging member may be formed from a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber. Non-limiting examples of metal oxides that may be used in embodiments include ZnO, $SnO_2$, $TiO_2$, $In_2O_3$, $MoO_3$ and complex oxides thereof. Further, a perchlorate may be added to the elastomer material to impart conductivity.

Further, a covering layer can also be provided on a surface of the contact charging member of embodiments. Non-limiting examples of materials that may be used in embodiments for forming a covering layer include N-alkoxy-methylated nylon, cellulose resins, vinylpyridine resins, phenol resins, polyurethanes, polyvinyl butyrals, melamines and, mixtures thereof. Furthermore, emulsion resin materials such as acrylic resin emulsions, polyester resin emulsions or polyurethanes, may be used. In order to further adjust resistivity, conductive agent particles may be dispersed in these resins, and in order to prevent deterioration, an antioxidant can also be added thereto. Further, in order to improve film-forming properties in forming the covering layer, a leveling agent or a surfactant may be added to the emulsion resin in embodiments of the invention.

The resistance of the contact-charging member of embodiments may be from $10^0$ to $10^{14}$ Ωcm, and from $10^2$ to $10^{12}$ Ωcm. When a voltage is applied to this contact-charging member, either a DC voltage or an AC voltage can be used as the applied voltage. Further, a superimposed voltage of a DC voltage and an AC voltage can also be used.

In the exemplary apparatus shown in FIG. 2, the contact-charging member of the contact-charging device 2 is in the shape of a roller. However, such a contact-charging member may be in the shape of a blade, a belt, a brush or the like.

Further, in embodiments an optical device that can perform desired imagewise exposure to a surface of the electrophotographic photoreceptor 1 with a light source such as a semiconductor laser, an LED (light emitting diode) or a liquid crystal shutter, may be used as the exposure device 3.

Furthermore, a known developing device using a normal or reversal developing agent of a one-component system, a two-component system or the like may be used in embodiments as the developing device 4. There is no particular limitation on toners that may be used in embodiments of the invention.

Contact type transfer charging devices using a belt, a roller, a film, a rubber blade or the like, or a scorotron transfer charger or a corotron transfer charger utilizing corona discharge may be employed as the transfer device 5, in various embodiments.

Further, in embodiments, the cleaning device 7 may be a device for removing a remaining toner adhered to the surface of the electrophotographic photoreceptor 1 after a transfer step, and the electrophotographic photoreceptor 1 repeatedly subjected to the above-mentioned image formation process may be cleaned thereby. In embodiments, the cleaning device 7 may be a cleaning blade, a cleaning brush, a cleaning roll or the like. Materials for the cleaning blade include urethane rubber, neoprene rubber and silicone rubber.

In the exemplary image forming device shown in FIG. 2, the respective steps of charging, exposure, development, transfer and cleaning are conducted in turn in the rotation step of the electrophotographic photoreceptor 1, thereby repeatedly performing image formation. The electrophotographic photoreceptor 1 may be provided with specified silicon compound-containing layers and photosensitive layers that satisfy equation (1), as described above, and thus photoreceptors having excellent discharge gas resistance, mechanical strength, scratch resistance, particle dispersibility, etc., may be provided. Accordingly, even in embodiments in which the photoreceptor is used together with the contact charging device or the cleaning blade, or further with spherical toner obtained by chemical polymerization, good image quality can be obtained without the occurrence of image defects such as fogging. That is, embodiments of the invention provide image-forming apparatuses that can stably provide good image quality for a long period of time is realized.

Figure 3:
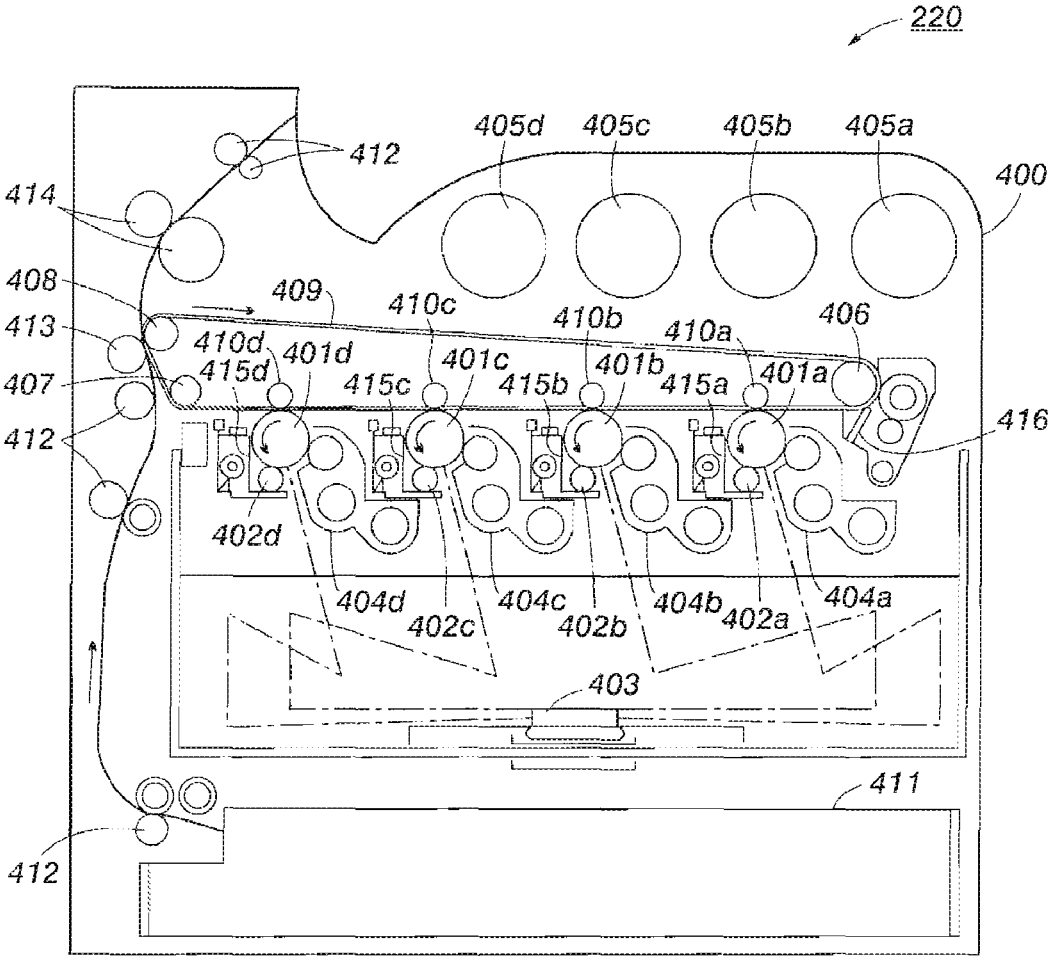
FIG. 3 is a schematic view showing another embodiment of an image forming apparatus.

FIG. 3 is a cross sectional view showing another exemplary embodiment of an image forming apparatus. The image forming apparatus 220 shown in FIG. 3 is an image forming apparatus of an intermediate transfer system, and four electrophotographic photoreceptors 401*a* to 401*d* are arranged in parallel with each other along an intermediate transfer belt 409 in a housing 400.

Here, the electrophotographic photoreceptors 401*a* to 401*d* carried by the image forming apparatus 220 are each the electrophotographic photoreceptors of the invention. Each of the electrophotographic photoreceptors 401*a* to 401*d* may rotate in a predetermined direction (counterclockwise on the sheet of FIG. 3), and charging rolls 402*a* to 402*d*, developing device 404*a* to 404*d*, primary transfer rolls 410*a* to 410*d* and cleaning blades 415*a* to 415*d* are each arranged along the rotational direction thereof. In each of the developing device 404*a* to 404*d*, four-color toners of yellow (Y), magenta (M), cyan (C) and black (B) contained in toner cartridges 405*a* to 405*d* can be supplied, and the primary transfer rolls 410*a* to 410*d* are each brought into abutting contact with the electrophotographic photoreceptors 401*a* to 401*d* through an intermediate transfer belt 409.

Further, a laser light source (exposure unit) 403 is arranged at a specified position in the housing 400, and it is possible to irradiate surfaces of the electrophotographic photoreceptors 401*a* to 401*d* after charging with laser light emitted from the laser light source 403. This performs the respective steps of charging, exposure, development, primary transfer and cleaning in turn in the rotation step of the electrophotographic photoreceptors 401*a* to 401*d*, and toner images of the respective colors are transferred onto the intermediate transfer belt 409, one over the other.

The intermediate transfer belt 409 is supported with a driving roil 406, a backup roll 408 and a tension roll 407 at a specified tension, and rotatable by the rotation of these rolls without the occurrence of deflection. Further, a secondary transfer roll 413 is arranged so that it is brought into abutting contact with the backup roll 408 through the intermediate transfer belt 409. The intermediate transfer belt 409, which has passed between the backup roll 408 and the secondary transfer roll 413, is cleaned up by a cleaning blade 416, and then repeatedly subjected to the subsequent image formation process.

Further, a tray (tray for a medium to which a toner image is to be transferred) 411 is provided at a specified position in the housing 400. The medium to which the toner image is to be transferred (such as paper) in the tray 411 is conveyed in turn between the intermediate transfer belt 409 and the secondary transfer roll 413, and further between two fixing rolls 414 brought into abutting contact with each other, with a conveying roll 412, and then delivered out of the housing 400.

According to the exemplary image forming apparatus 220 shown in FIG. 3, the use of electrophotographic photoreceptors of embodiments of the invention as electrophotographic photoreceptors 401*a* to 401*d* may achieve discharge gas resistance, mechanical strength, scratch resistance, etc. on a sufficiently high level in the image formation process of each of the electrophotographic photoreceptors 401*a* to 401*d*. Accordingly, even when the photoreceptors are used together with the contact charging devices or the cleaning blades, or further with the spherical toner obtained by chemical polymerization, good image quality can be obtained without the occurrence of image defects such as fogging. Therefore, also according to the image forming apparatus for color image formation using the intermediate transfer body, such as this embodiment, the image forming apparatus, which can stably provide good image quality for a long period of time is realized.

The invention should not be construed as being limited to the above-mentioned embodiments. For example, each apparatus shown in FIG. 2 or 3 may be equipped with a process cartridge comprising the electrophotographic photoreceptor 1 (or the electrophotographic photoreceptors 401*a* to 401*d*) and charging device 2 (or the charging devices 402*a* to 402*d*). The use of such a process cartridge allows maintenance to be performed more simply and easily.

Further, in embodiments, when a charging device of the non-contact charging system such as a corotron charger is used in place of the contact charging device 2 (or the contact charging devices 402*a* to 402*d*), sufficiently good image quality can be obtained.

Furthermore, in the embodiment of an apparatus that is shown in FIG. 2, a toner image formed on the surface of the electrophotographic photoreceptor 1 is directly transferred to the medium P to which the toner image is to be transferred. However, the image forming apparatus of the invention may be further provided with an intermediate transfer body. This makes it possible to transfer the toner image from the intermediate transfer body to the medium P to which the toner image is to be transferred, after the toner image on the surface of the electrophotographic photoreceptor 1 has been transferred to the intermediate transfer body. As such an intermediate transfer body, there can be used one having a structure in which an elastic layer containing a rubber, an elastomer, a resin or the like and at least one covering layer are laminated on a conductive support.

Specific examples are described in detail below. These examples are intended to be illustrative, and the materials, conditions, and process parameters set forth in these exemplary embodiments are not limiting. All parts and percentages are by weight unless otherwise indicated.

EXAMPLE 1

An electrophotographic photoreceptor was prepared in the following manner. A coating solution for an undercoat layer comprising 100 parts of a ziconium compound (trade name: Orgatics ZC540), 10 parts of a si lane compound (trade name: A110, manufactured by Nippon Unicar Co., Ltd), 400 parts of isopropanol solution and 200 parts of butanol was prepared. The coating solution was applied onto a cylindrical Al substrate subjected to honing treatment by dip coating, and dried by heating at 150° C. for 10 minutes to form an undercoat layer having a film thickness of 0.1 micrometer.

A 0.5 micron thick charge generating layer was subsequently dip coated on top of the undercoat layer from a dispersion of Type V hydroxygallium phthalocyanine (12 parts), alkylhydroxy gallium phthalocyanine (3 parts), and a vinyl chloride/vinyl acetate copolymer, VMCH (Mn=27,000, about 86 weight percent of vinyl chloride, about 13 weight percent of vinyl acetate and about 1 weight percent of maleic acid) available from Dow Chemical (10 parts), in 475 parts of n-butylacetate.

Subsequently, a 20 μm thick charge transport layer (CTL) was dip coated on top of the charge generating layer from a solution of N,N'-diphenyl-N,N'-bis(3-methylphenyl)-1,1-biphenyl-4,4'-diamine (82.3 parts), 2.1 parts of 2,6-Di-tert-butyl-4-methylphenol (BHT) from Aldrich and a polycarbonate, PCZ-400 [poly(4,4'-dihydroxy-diphenyl-1-1-cyclohexane), $M_w$=40,000] available from Mitsubishi Gas Chemical Company, Ltd. (123.5 parts) in a mixture of 546 parts of tetrahydrofuran (THF) and 234 parts of monochlorobenzene. The CTL was dried at 115° C. for 60 minutes.

An overcoat layer formulation was prepared as follows:

Step 1. 5.8 parts of a compound of Formula (I-A) as shown below, 11 parts of a compound of Formula (II-G) as shown below, and 11 parts of methanol were mixed, and 2 parts of an ion exchange resin (Amberlist H15) were added thereto, followed by stirring for 2 hours.

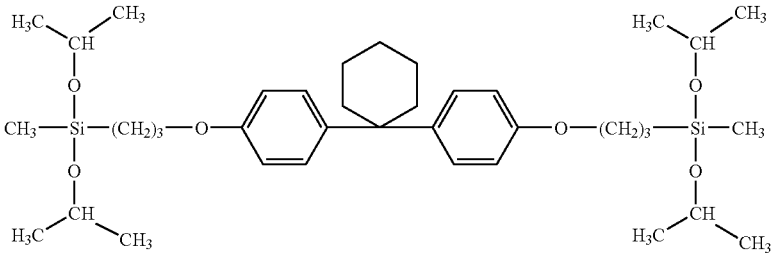

Compound of Formula (I-A)

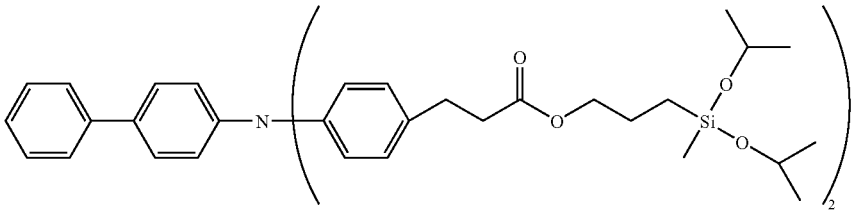

Compound of Formula (II-G)

Step 2. 32 parts of butanol and 4.92 parts of distilled water were added to the mixture, followed by stirring at room temperature for 30 minutes. Then, the resulting mixture was filtered to remove the ion exchange resin.

Step 3. 0.180 parts of aluminum trisacetylacetonate (Al $(AcAc)_3$), 0.180 parts of acetylacetone (AcAc), 2 parts of a polyvinyl butyral resin (trade name: BX-L, manufactured by Sekisui Chemical Co., Ltd.), 0.0180 parts of butylated-hydroxytoluene (BHT), 0.261 parts of a hindered phenol antioxidant (IrGANGX 1010), and 4.5 parts of CERFLON SLA-2020 (a commercially available isopropanol dispersion comprising 22 weight percent of particulate boron nitride and polytetrafluoroethylene composites, purchased from Acheson, Inc.) were added to the filtrate obtained in Step 2 and thoroughly mixed therein for 2 hours. The mixture was filtered through a 6 μm glass fiber filter to obtain a coating solution for an overcoat layer. The coating solution thus prepared was applied onto a charge transfer layer by dip coating and dried by heating at 130° C. for one hour to form the protective layer having a film thickness of around 3 μm, thereby obtaining a desired electrophotographic photoreceptor.

EXAMPLE 2

An electrophotographic photoreceptor was prepared in a similar manner as described in Example 1, except that the overcoat solution was further added in Step 3 with 0.06 part of FLUOROLINK S-10 (a perfluoropolyether purchased from Solvay Solexis, Inc.). The coating solution thus prepared was applied onto a charge transfer layer by dip coating and dried by heating at 130° C. for one hour to form the protective layer having a film thickness of around 3 μm, thereby obtaining a desired electrophotographic photoreceptor.

Photoreceptor Device: Comparative Example

A comparative example of electrophotographic photoreceptor was prepared in a similar manner as described in Example 1, except that no CERFLON SLA-2020 was added in the preparation of overcoat solution.

Evaluation of Electrophotographic Photoreceptor Performance:

The electrical performance characteristics of the above prepared photoreceptors such as electrophotographic sensitivity and short term cycling stability were tested in a scanner. The scanner is known in the industry and equipped with means to rotate the drum while it is electrically charged and discharged. The charge on the photoconductor sample is monitored through use of electrostatic probes placed at precise positions around the circumference of the device. The photoreceptor devices are charged to a negative potential of 500 Volts. As the devices rotate, the initial charging potentials are measured by voltage probe 1. The photoconductor samples are then exposed to monochromatic radiation of known intensity, and the surface potential measured by voltage probes 2 and 3. Finally, the samples are exposed to an erase lamp of appropriate intensity and wavelength and any residual potential is measure by voltage probe 4. The process is repeated under the control of the scanner's computer, and the data is stored in the computer. The PIDC (photo induced discharge curve) is obtained by plotting the potentials at voltage probes 2 and 3 as a function of the light energy. All the photoreceptors as prepared in Examples 1 and 2, showed similar PIDC characteristics as the control or Comparative Example device.

The electrical cycling performance of the photoreceptor was performed using a fixture similar to a xerographic system. The photoreceptor devices (Example 1, Example 2, and the comparative example) with the overcoat showed stable cycling of over 170,000 cycles in a humid environment (28° C., 80% RH).

The electrical testing results of the photoreceptors as measured above indicate that the addition of the particulate boron nitride and PTFE has minimal impact on the electrical characteristics of the photoreceptors.

The torque properties, measured in Newton-meter, of the photoreceptor are measured in the following manner. A photoreceptor was placed in a xerographic customer replaceable unit (CRU), as is used in a DC555 (manufactured by Xerox Corporation). The torque properties of the photoreceptor were measured before and after 500 prints with DC555. As a result, the photoreceptors as fabricated in Example 1 and 2 maintained a low torque before and after print test. As a comparison, the comparative photoreceptor displayed a low torque, but its torque increased more than 20% after print test. The results show that the addition of the particulate boron nitride and PTFE in the overcoat offers torque improvement.

The image quality of the photoreceptors containing the composite overcoat was evaluated by print test using a printing machine equipped with the electrophotographic photoreceptor described herein under an ambient environment (for example, 23° C. and 65% relative humidity). No adverse impact on initial image quality and the image quality after 1,000 prints was observed.

EXAMPLE 3

An electrophotographic photoreceptor having a backing layer (or anti-curling layer) was prepared in the following manner:

A photoconductor was prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator, a solution containing 50 parts of 3-amino-propyltriethoxysilane, parts of water, 15 parts of acetic acid, 684.8 parts of denatured alcohol, and 200 parts of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer, using a gravure applicator, and which adhesive contains 0.2 percent by weight based on the total weight of the solution of copolyester adhesive (Ardel D100™ available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 parts of the known polycarbonate lupilon 200™ (PCZ-200) or Polycarbonate Z™, weight average molecular weight of 20,000, available from Mitsubishi Gas Chemical Corporation, and 50 parts of tetrahydrofuran into a glass bottle. To this solution were added 2.4 parts of hydroxygallium phthalocyanine (Type V) and 300 parts of ⅛-inch (3.2 millimeters) diameter stainless steel shot. This mixture was then placed on a ball mill for 8 hours. Subsequently, 2.25 parts of PCZ-200 were dissolved in 46.1 parts of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form, a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The charge generation layer was dried at 135° C. for 5 minutes in a forced air oven to form a dry photogenerating layer having a thickness of 0.4 micrometer.

The above photogenerating layer was overcoated with a charge transport layer prepared by introducing into an amber glass bottle 45 weight percent of N,N'-bis(3-methylphenyl)-N,N'-diphenyl-1,1-biphenyl-4,4'-diamine and 55 weight percent of Makrolon 5705®, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 30 microns.

The back of the above polyethylene naphthalate substrate was coated with an anti-curling layer of a polycarbonate comprising particulate boron nitride and PTFE. The coating solution can be prepared by dispersing 3 weight percent (solid content) of commercially available SLA2010 (purchased from Acheson, Inc.) and 97 weight percent of Makrolon 5705®, commercially available from Farbenfabriken Bayer A.G. in methylene chloride. The thickness of the layer after drying (120° C. for 1 minute) arranges from 5 to 25 microns. The improved backing layer is expected to offer lower friction and improved mechanical robustness.

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An overcoat layer for electrophotographic imaging members, comprising:

a polymer matrix;

a particulate inorganic lubricant comprising a plurality of boron nitride particles ranging in size of from about 0.05 to about 5 μm; and a particulate fluoropolymer comprising a plurality of particles ranging in size of from about 0.05 to about 5 μm;

wherein the particulate inorganic lubricant and the particulate fluoropolymer are uniformly dispersed throughout the matrix, said particulate inorganic lubricant is present at from about 0.5 to about 10% by weight, relative to a total weight of the overcoat layer, and said particulate fluoropolymer is present at from about 1 to about 20% by weight, relative to a total weight of the overcoat layer, said polymer matrix comprises a cross-linked polysiloxane, wherein the cross-linked polysiloxane is produced by hydrolysis and condensation of a coating formulation that comprises an aromatic silicon-containing compound of Formula (I) and a silicon-containing hole-transport compound of Formula (II):

$$A\text{-}[L\text{-}SiR_nX_{3-n}]_m \quad (I)$$

$$B\text{-}[L\text{-}SiR_nX_{3-n}]_m \quad (II)$$

where A is a multiple-valent organic group;

B is a hole-transport moiety;

L is a divalent linkage;

R is a hydrocarbon group selected from the group consisting of alkyl groups, arylalkyl groups, aryl groups, and alkylaryl groups;

X is a hydrolytic group;

m is an integer from 1 to 6;

n is an integer from 0 to 2; and the m, n, L, R, and X of Formulas (I) and (II) are independently selected; and wherein the silicon-containing hole-transport compound of Formula (II) is selected from the group consisting of compounds of Formulas (II-A) through (II-F) and (II-K) through (II-N):

(II-A)

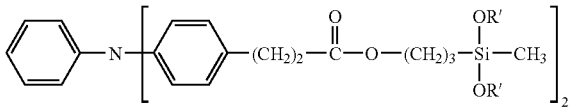

(II-B)

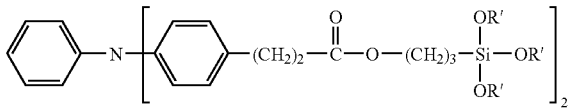

(II-C)

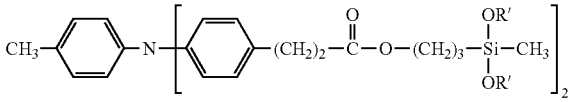

(II-D)

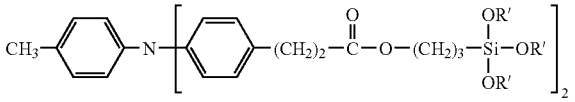

(II-E)

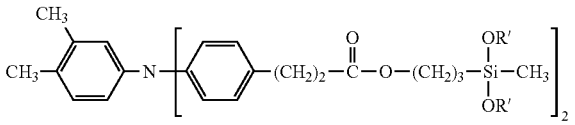

(II-F)

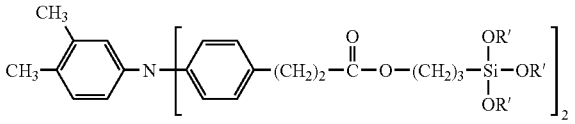

(II-K)

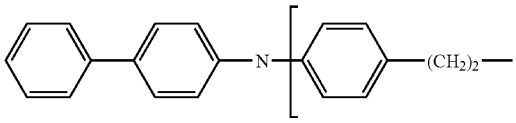

-continued

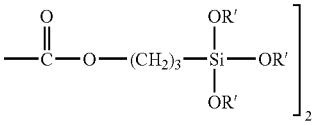

(II-L)

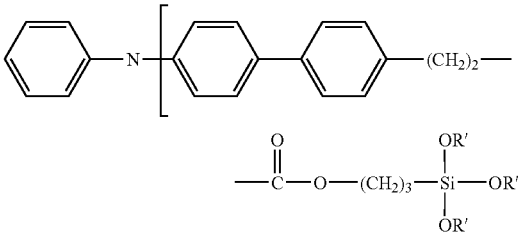

(II-M)

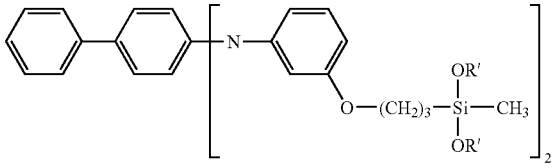

(II-N)

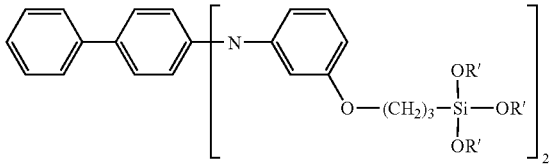

in which R' is an alkyl group having from 1 to about 4 carbon atoms.

2. The overcoat layer according to claim 1, wherein said particulate fluoropolymer is selected from the group consisting of poly(tetrafluoroethylene) (PTFE), poly(vinylidene fluoride), poly(vinylidene fluoride co-hexafluoropropylene), and mixtures thereof.

3. The overcoat layer according to claim 1, wherein said particulate fluoropolymer comprises a plurality of poly(tetrafluoroethylene) particles ranging in size of from about 0.05 to about 5 μm.

4. The overcoat layer according to claim 1, further comprising a charge-transport component.

5. The overcoat layer according to claim 4, wherein said charge-transport component is present at from about 25 to about 60% by weight, relative to a total weight of the overcoat layer.

6. The overcoat layer according to claim 1, wherein, in Formula (I):

L is an independently selected divalent linkage selected from the group consisting of:

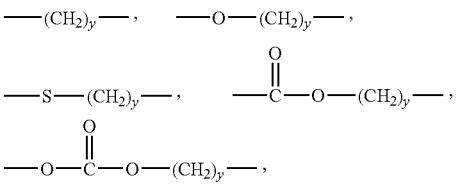

-continued
$$-(CH_2)_z-\overset{O}{\overset{\|}{C}}-O-(CH_2)_y-,$$
$$-O-\overset{O}{\overset{\|}{C}}-NH-(CH_2)_y-,$$
$$-CH{=}CH-(CH_2)_y-, \quad \text{and}$$
$$-CH{=}CH-\overset{O}{\overset{\|}{C}}-O-(CH_2)_y-;$$
in which y is an integer from 1 to about 6 and z is an integer from 1 to about 6; and
A is a multiple-valent organic group selected from the group consisting of:
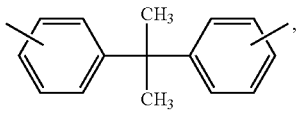
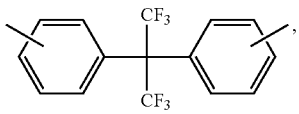
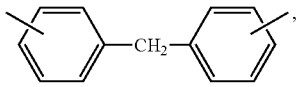
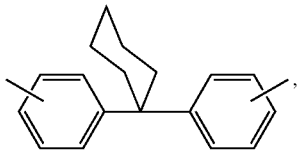
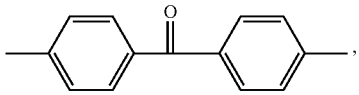
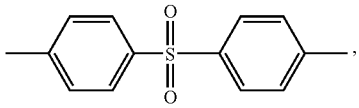
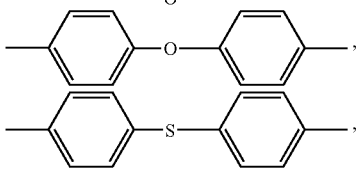
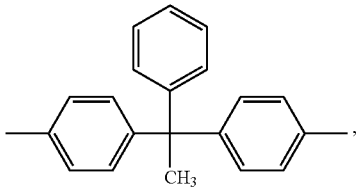
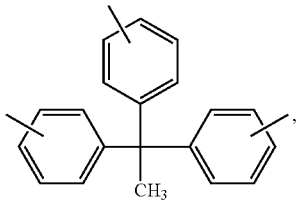
-continued
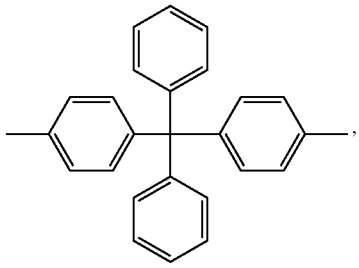
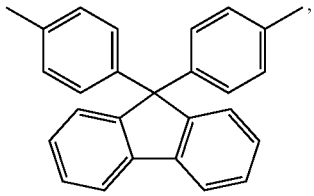
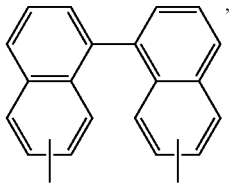
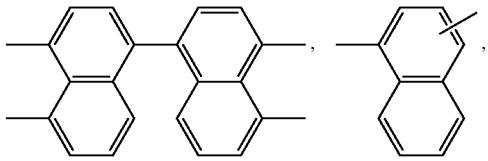
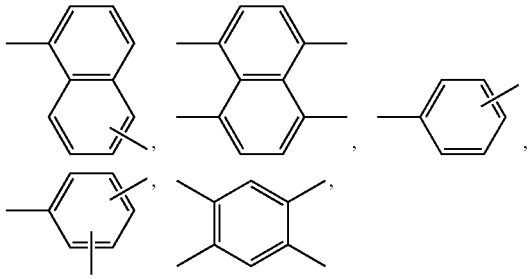
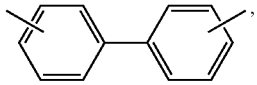
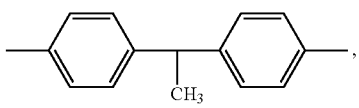
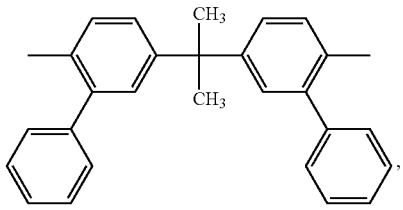

-continued

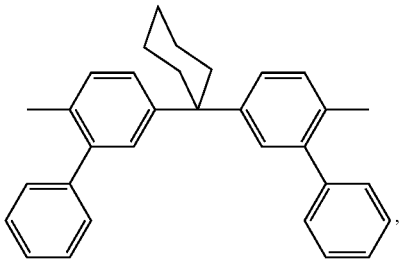

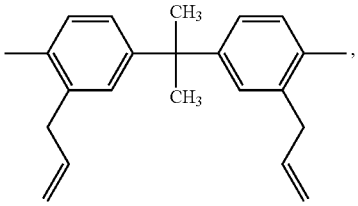

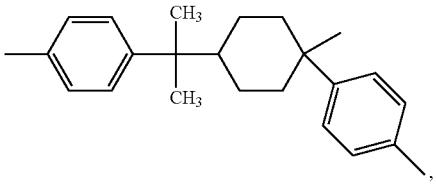

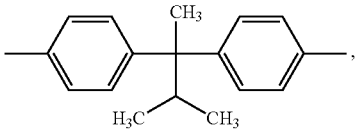

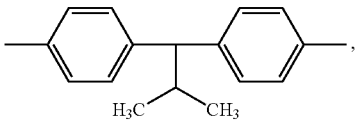

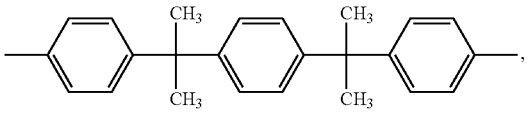

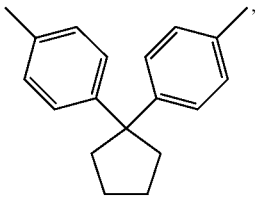

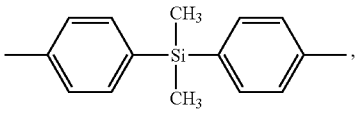

and

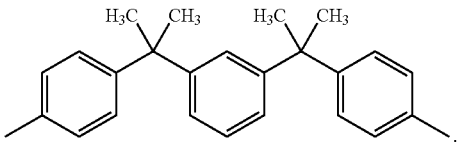

7. The overcoat layer according to claim 1, wherein the aromatic silicon-containing compound of Formula (I) is selected from the group consisting of compounds of Formulas (I-A), (I-B) and (I-C):

(I-A)

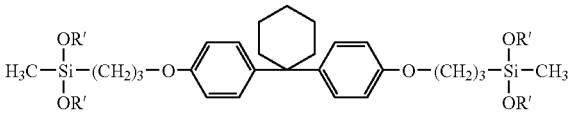

(I-B)

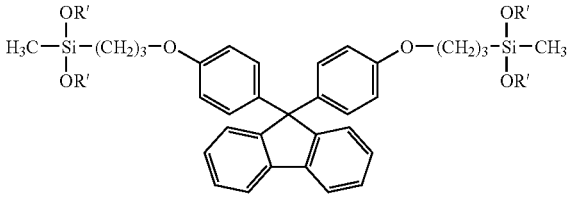

(I-C)

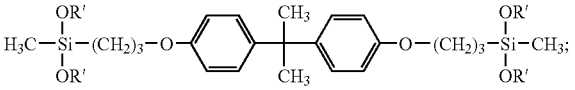

in which R' is an alkyl group having from 1 to about 4 carbon atoms.

8. An electrophotographic imaging member comprising:

a substrate, a charge-generating layer, a charge-transporting layer, and an overcoat layer;

wherein said overcoat layer comprises:

a polymer matrix;

a particulate inorganic lubricant comprising a plurality of boron nitride particles ranging in size of from about 0.05 to about 5 μm; and a particulate fluoropolymer comprising a plurality of particles ranging in size of from about 0.05 to about 5 μm;

wherein the particulate inorganic lubricant and the particulate fluoropolymer are uniformly dispersed throughout the matrix, said particulate inorganic lubricant is present at from about 0.5 to about 10% by weight, relative to a total weight of the overcoat layer, and said particulate fluoropolymer is present at from about 1 to about 20% by weight, relative to a total weight of the overcoat layer, said polymer matrix comprises a cross-linked polysiloxane, wherein the cross-linked polysiloxane is produced by hydrolysis and condensation of a coating formulation that comprises an aromatic silicon-containing compound of Formula (I) and a silicon-containing hole-transport compound of Formula (II):

$$A\text{-}[L\text{-}SiR_nX_{3-n}]_m \quad (I)$$

$$B\text{-}[L\text{-}SiR_nX_{3-n}]_m \quad (II)$$

where A is a multiple-valent organic group;

B is a hole-transport moiety;

L is a divalent linkage;

R is a hydrocarbon group selected from the group consisting of alkyl groups, arylalkyl groups, aryl groups, and alkylaryl groups;

X is a hydrolytic group;

m is an integer from 1 to 6;

n is an integer from 0 to 2; and the m, n, L, R, and X of Formulas (I) and (II) are independently selected; and wherein the silicon-containing hole-transport compound of Formula (II) is selected from the group consisting of compounds of Formulas (II-A) through (II-F) and (II-K) through (II-N):

(II-B)
(II-A)

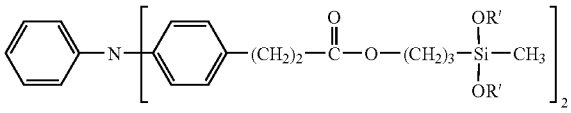

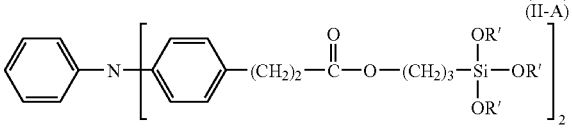

(II-D)
(II-C)

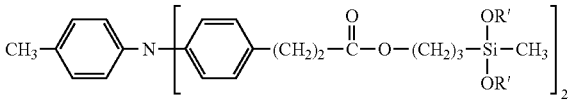

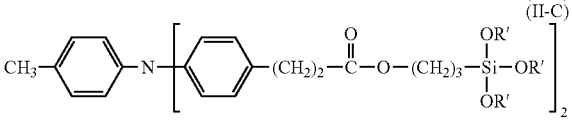

(II-F)
(II-E)

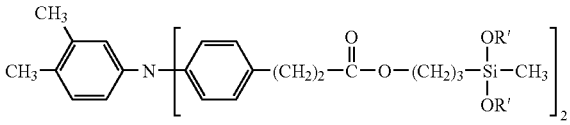

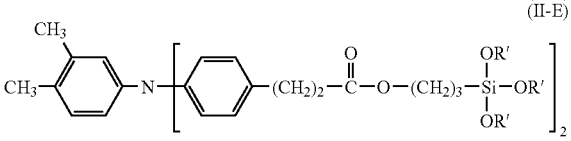

(II-G)

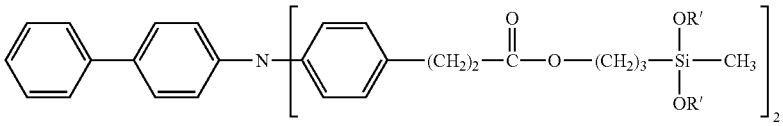

(II-H)

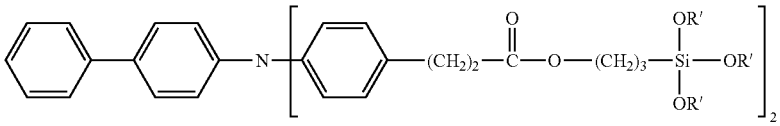

(II-I)

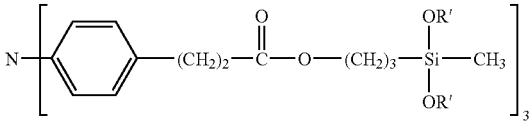

(II-J)

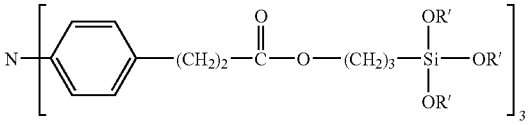

(II-K)

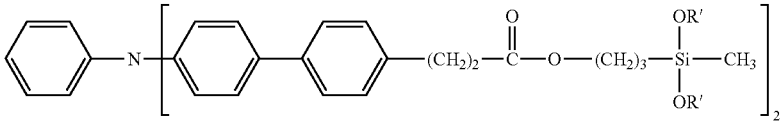

(II-L)

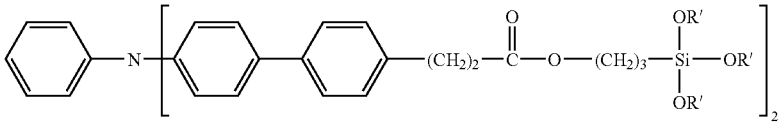

(II-N)
(II-M)

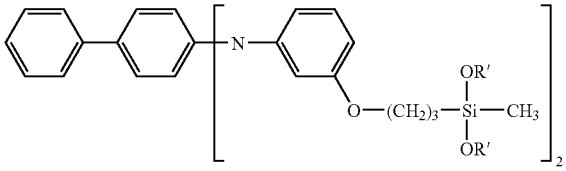

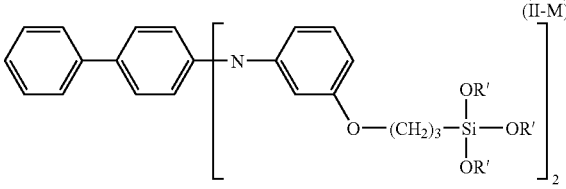

in which R' is an alkyl group having from 1 to about 4 carbon atoms.

9. The electrophotographic imaging member according to claim 8, wherein said particulate fluoropolymer is selected from the group consisting of poly(tetrafluoroethylene) (PTFE), poly(vinylidene fluoride), poly(vinylidene fluoride co-hexafluoropropylene), and mixtures thereof.

10. The electrophotographic imaging member according to claim 8, wherein said particulate fluoropolymer comprises a plurality of poly(tetrafluoroethylene) particles ranging in size of from about 0.05 to about 5 μm.

11. The electrophotographic imaging member according to claim 8, wherein said overcoat layer further comprises a charge-transport component.

12. The electrophotographic imaging member according to claim 11, wherein said charge-transport component is present at from about 25 to about 60% by weight, relative to a total weight of the overcoat layer.

13. The electrophotographic imaging member according to claim 8, wherein, in Formula (I):

L is an independently selected divalent linkage selected from the group consisting of:

$$-(CH_2)_y-,\quad -O-(CH_2)_y-,$$

$$-S-(CH_2)_y-,\quad -\overset{O}{\overset{\|}{C}}-O-(CH_2)_y-,$$

$$-O-\overset{O}{\overset{\|}{C}}-O-(CH_2)_y-,$$

$$-(CH_2)_z-\overset{O}{\overset{\|}{C}}-O-(CH_2)_y-,$$

$$-O-\overset{O}{\overset{\|}{C}}-NH-(CH_2)_y-,$$

$$-CH{=}CH-(CH_2)_y-,\quad \text{and}$$

$$-CH{=}CH-\overset{O}{\overset{\|}{C}}-O-(CH_2)_y-;$$

in which y is an integer from 1 to about 6 and z is an integer from 1 to about 6; and A is a multiple-valent organic group selected from the group consisting of:

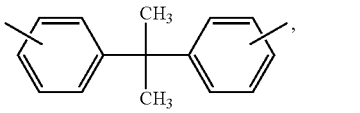

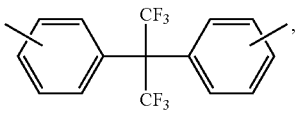

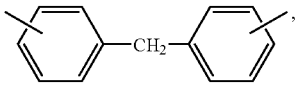

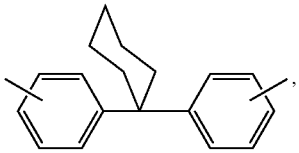

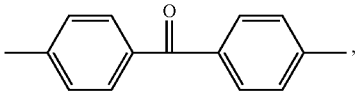

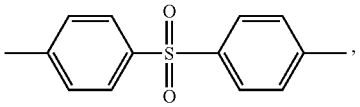

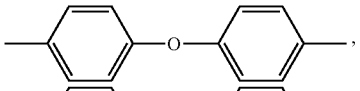

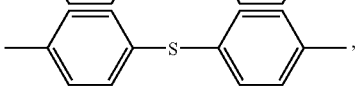

-continued

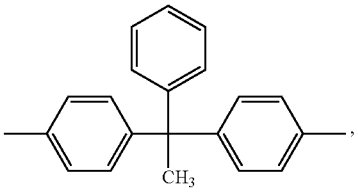

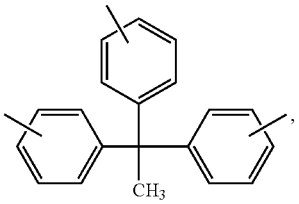

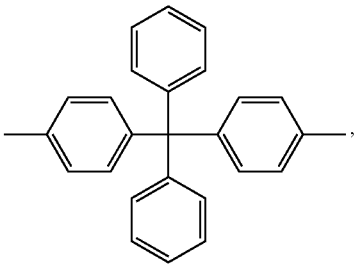

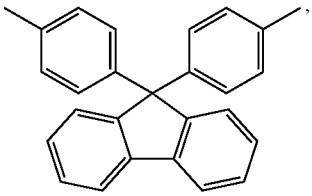

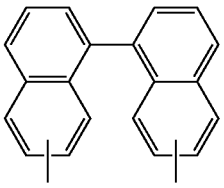

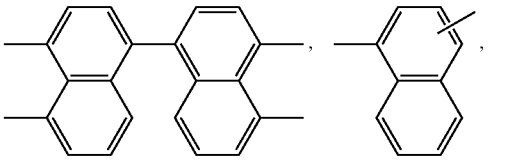

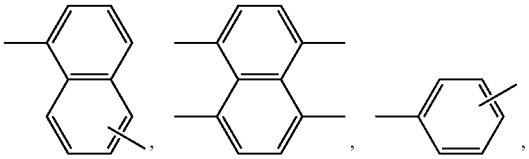

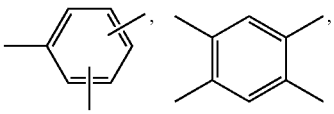

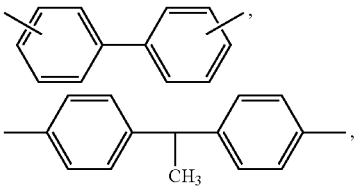

-continued

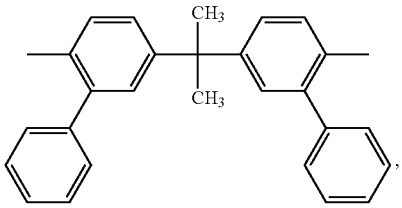

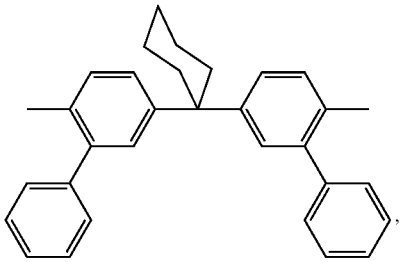

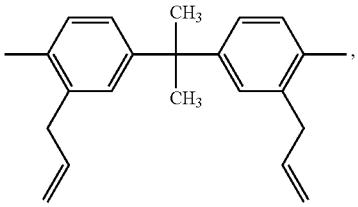

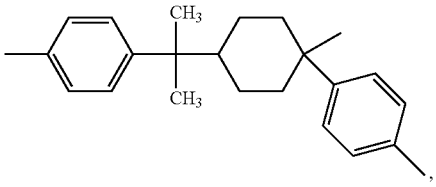

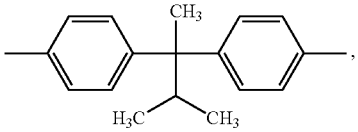

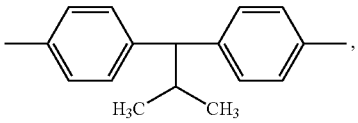

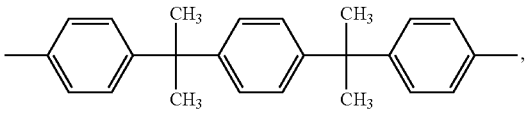

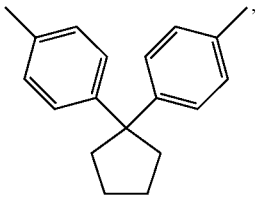

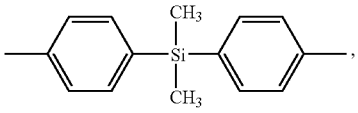

and

-continued

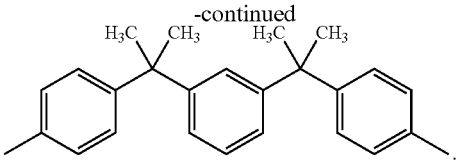

14. The electrophotographic imaging member according to claim 8, wherein the aromatic silicon-containing compound of Formula (I) is selected from the group consisting of compounds of Formulas (I-A), (I-B) and (I-C):

(I-A)

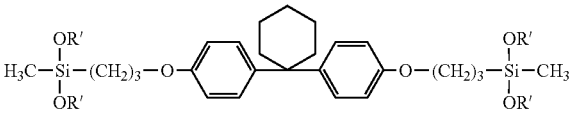

(I-B)

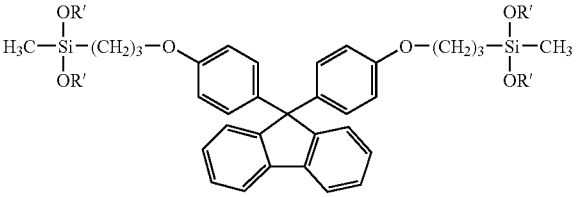

(I-C)

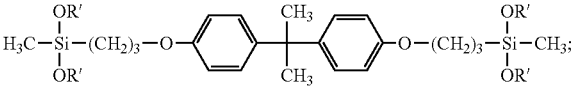

in which R' is an alkyl group having from 1 to about 4 carbon atoms.

15. An electrophotographic imaging apparatus comprising:

a charging unit;

a cleaning unit; and an electrophotographic imaging member;

wherein said electrophotographic imaging member comprises:

a substrate;

an optional hole-blocking layer;

a charge-generating layer comprising a photosensitive pigment;

a charge-transporting layer comprising a polycarbonate polymer binder and at least one charge-transport material; and an overcoat layer;

wherein said overcoat layer comprises:

a polymer matrix;

a particulate inorganic lubricant comprising a plurality of boron nitride particles ranging in size of from about 0.05 to about 5 μm; and a particulate fluoropolymer comprising a plurality of particles ranging in size of from about 0.05 to about 5 μM;

wherein the particulate inorganic lubricant and the particulate fluoropolymer are uniformly dispersed throughout the matrix, said particulate inorganic lubricant is present at from about 0.5 to about 10% by weight, relative to a total weight of the overcoat layer, and said particulate fluoropolymer is present at from about 1 to about 20% by weight, relative to a total weight of the overcoat layer, said polymer matrix comprises a cross-linked polysiloxane, wherein the cross-linked polysiloxane is produced by hydrolysis and condensation of a coating formulation that comprises an aromatic silicon-containing compound of Formula (I) and a silicon-containing hole-transport compound of Formula (II):

$$A\text{-}[L\text{-}SiR_nX_{3-n}]_m \quad (I)$$

$$B\text{-}[L\text{-}SiR_nX_{3-n}]_m \quad (II)$$

where A is a multiple-valent organic group;

B is a hole-transport moiety;

L is a divalent linkage;

R is a hydrocarbon group selected from the group consisting of alkyl groups, arylalkyl groups, aryl groups, and alkylaryl groups;

X is a hydrolytic group;

m is an integer from 1 to 6;

n is an integer from 0 to 2; and the m, n, L, R, and X of Formulas (I) and (II) are independently selected; and wherein the silicon-containing hole-transport compound of Formula (II) is selected from the group consisting of compounds of Formulas (II-A) through (II-F) and (II-K) through (II-N):

(II-B)
(II-A)

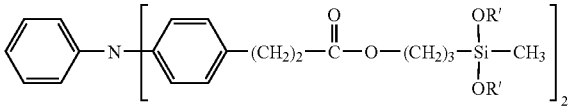

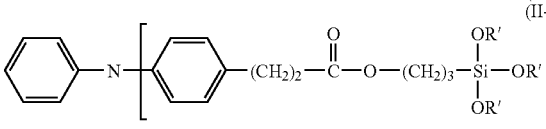

(II-D)
(II-C)

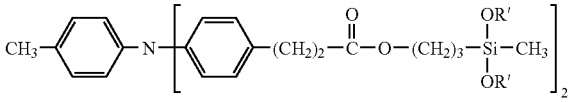

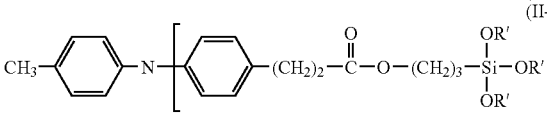

(II-F)
(II-E)

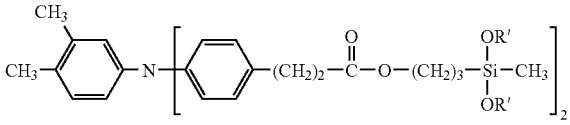

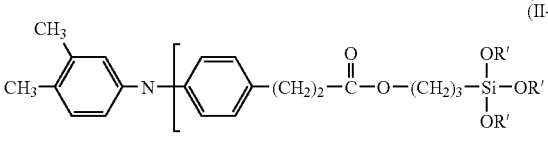

(II-G)

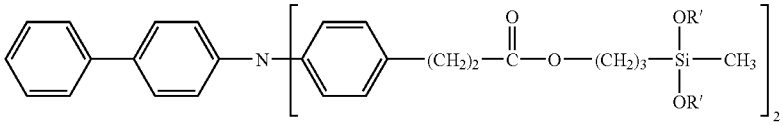

(II-H)

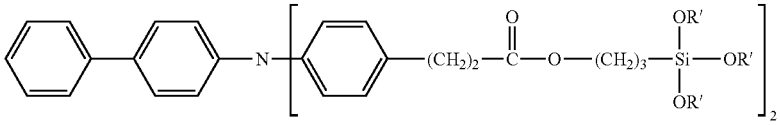

(II-I)

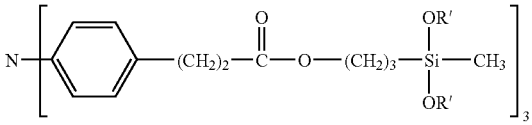

(II-J)

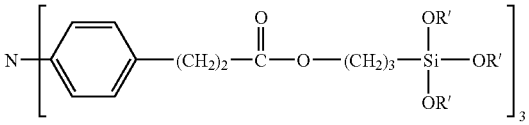

(II-K)

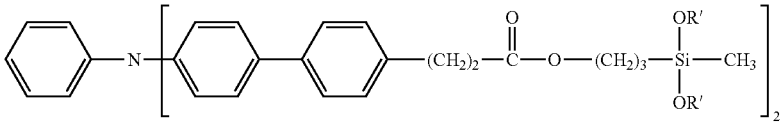

(II-L)

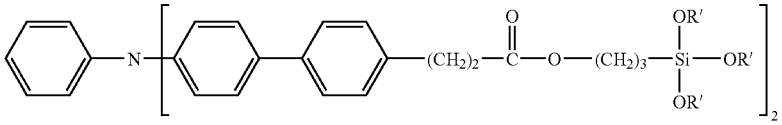

-continued
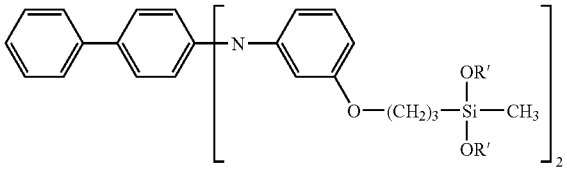
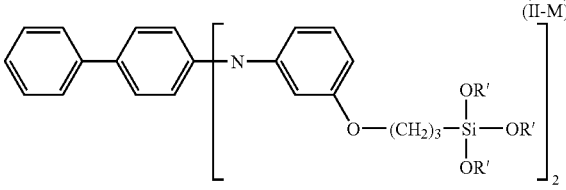
in which R' is an alkyl group having from 1 to about 4 carbon atoms.
16. The electrophotographic imaging apparatus according to claim 15, wherein said charging unit comprises an AC bias charging roll that contacts and charges the electrophotographic imaging member.
* * * * *